US008246286B2

(12) United States Patent
Fukudome et al.

(10) Patent No.: US 8,246,286 B2
(45) Date of Patent: Aug. 21, 2012

(54) LOADER WORK APPARATUS

(75) Inventors: Hiroki Fukudome, Sakai (JP); Masataka Takagi, Sakai (JP); Koji Saito, Sakai (JP); Eiji Miyazaki, Sakai (JP); Shuichi Takeshita, Sakai (JP)

(73) Assignee: Kubota Corporation, Osaka (JP)

( * ) Notice: Subject to any disclaimer, the term of this patent is extended or adjusted under 35 U.S.C. 154(b) by 58 days.

(21) Appl. No.: 11/726,377

(22) Filed: Mar. 21, 2007

(65) Prior Publication Data

US 2007/0243052 A1 Oct. 18, 2007

(30) Foreign Application Priority Data

Mar. 27, 2006 (JP) ..... 2006-086357
Jul. 5, 2006 (JP) ..... 2006-185513
Jul. 20, 2006 (JP) ..... 2006-198570

(51) Int. Cl.
*E02F 3/36* (2006.01)

(52) U.S. Cl. ..... 414/686; 414/724; 414/918

(58) Field of Classification Search ..... 414/686, 414/724, 918

See application file for complete search history.

(56) References Cited

U.S. PATENT DOCUMENTS 3,324,954 A * 6/1967 Westendorf ..... 172/1
3,912,095 A * 10/1975 Miller ..... 414/686
6,994,511 B2 * 2/2006 Westendorf et al. ..... 414/686
7,354,238 B2 * 4/2008 Fukudome et al. ..... 414/686
7,354,239 B2 * 4/2008 Deyo et al. ..... 414/724
2006/0182598 A1 * 8/2006 Fukudome et al. ..... 414/722

FOREIGN PATENT DOCUMENTS

JP 55126362 U1 9/1980
JP 2001-140276 5/2001
JP 2004-114762 4/2004
JP 2005-016023 1/2005
JP 2005-117984 5/2005

* cited by examiner

*Primary Examiner* — Donald Underwood
(74) *Attorney, Agent, or Firm* — The Webb Law Firm

(57) ABSTRACT

A work apparatus to be mounted to a work vehicle includes: a pair of cylindrical masts 35 disposed erect on right and left sides of a vehicle body having a control valve; a boom 91 pivotally supported to the masts; an implement pivotally supported to the boom; a boom cylinder 60 for pivoting the boom; an implement cylinder 61 for operating the implement; a boom piping system communicating the control valve with the boom cylinder; and an implement piping system communicating the control valve with the implement cylinder; wherein a channel constituting member 84 constituting the boom piping system extends vertically within each mast; one end of the channel constituting member 84 extends to the outside at a lower portion of the mast to be connected with the control valve; and the other end of the channel constituting member 84 extends to the outside at an upper portion of the mast 35 to be connected with boom cylinder 60.

17 Claims, 18 Drawing Sheets

LOADER WORK APPARATUS

BACKGROUND OF THE INVENTION

1. Field of the Invention

The present invention relates to a loader work apparatus to be mounted to a work vehicle such as a tractor.

2. Description of Related Art

There is known a loader work machine having a pair of masts projecting upward on right and left sides of a body of a tractor and a loader mounted to upper portions of the masts, the loader having a bucket and a boom.

With this loader work machine, the boom of the loader has its base end pivotally supported to the mast and this boom is vertically pivotable by a boom cylinder interposed between the boom and the mast. Further, at a leading end of the boom, there are disposed a bucket and a bucket cylinder, so that in association with an expanding or contracting movement of the bucket cylinder the bucket effects a scooping or dumping operation. Further, a control valve is attached to the mast for controlling a supply amount of pressure oil to be supplied to the boom cylinder and the bucket cylinder. And, a control lever extends from this control valve toward a driver's seat. Pivotal movements of the boom cylinder and the bucket cylinder are controlled by operations of this control lever.

Further, for the purpose of obtaining multiple functions of the loader work apparatus, there has been proposed a loader work machine which allows mounting, to the leading end of the boom, of such an attachment as a fork, grapple, etc., which is operable by two hydraulic actuators, in place of the bucket (e.g. JP2005-117984A). With this loader work machine, an attachment piping system is needed, in addition to a piping system for the bucket.

SUMMARY OF THE INVENTION

Incidentally, in the above-described loader work machine, if the control valve is disposed downwardly of the driver's seat in order to improve the operability of the control lever for controlling the control valve, such a channel constituting element as a hydraulic hose forming a piping system for the attachment will extend through the inner side or outer side of the mast to the control valve.

However, if this hydraulic hose is exposed on the inner side of the mast, this will not only impair the commercial value, but also hinder the driver's view to the front side of the vehicle body. On the other hand, if the hydraulic hose is exposed on the outer side of the mast, this may result in not only increase in the vehicle width, but also premature damage of the hydraulic hose due to impact or friction thereof to e.g. an obstacle present on a lateral side of the vehicle body. Hence, such arrangements are undesirable.

In view of the above, the object of the present invention is to provide a loader work apparatus which allows a hydraulic hose to be disposed without the hose extending on the inner or outer side of the mast, the hydraulic hose constituting a piping system extending from a control valve mounted on the vehicle body to a hydraulic actuator for an attachment to be mounted to the boom.

According to a characterizing feature of a loader work machine relating to the present invention, a work apparatus to be mounted to a work vehicle, comprises:

first and second masts disposed erect on right and left sides of a vehicle body having a control valve;

a boom pivotally supported to said masts;

an implement pivotally supported to said boom;

a boom cylinder for pivoting said boom;

an implement cylinder for operating said implement;

a boom piping system communicating said control valve with said boom cylinder; and an implement piping system communicating said control valve with said implement cylinder;

wherein a channel constituting member constituting said boom piping system extends vertically within said first mast; one end of said channel constituting member extends to the outside at a lower portion of said first mast to be connected with said control valve; and the other end of said channel constituting member extends to the outside at an upper portion of said first mast to be connected with boom cylinder.

With the above-described construction, the channel constituting member extending from the control valve is disposed through the inside of the mast to the loader. Therefore, there is eliminated the risk of this channel constituting member hindering the driver's front side view. Further, as this channel constituting member is protected within the mast, there is also no risk of the member being damaged through its collision with an obstacle or the like present on a lateral side of the vehicle body. Still further, as the channel constituting member is hidden inside the mast, the appearance of the entire loader work machine will be improved also.

In the above-described construction, preferably, the boom cylinder includes a cylinder tube and a piston rod projectable and retractable relative to said cylinder tube, said piston rod being pivotally supported to an intermediate portion of said boom, said cylinder tube being pivotally supported to said mast, said channel constituting member being connected with a piston rod side end of said cylinder tube and a mast side end of said cylinder tube, respectively.

With the above, the cylinder tube whose length is invariable regardless of pivotal movements of the boom is pivotally supported to the mast and the channel constituting member is connected to this cylinder tube. Therefore, even with the expansion/contraction of the piston rod associated with pivotal movement of the boom, there will hardly occur displacement (back and forth movement) in the piston rod, of a joint between this channel constituting member and the cylinder tube. Therefore, the channel constituting member only needs such an amount of play which allows the member to follow the pivotal movement of the hydraulic cylinder. With this, the channel constituting member can be formed short and compact.

Further, in the above-described construction, preferably, at an upper portion of said mast, there are provided a boom pivot portion for pivotally supporting said boom and a cylinder pivot portion for pivotally supporting said cylinder, with one being disposed above the other; and said channel constituting member extends to the outside of the mast from between said boom pivot portion and said cylinder pivot portion.

With the above, the hydraulic cylinder for pivoting the boom and the boom are disposed with one being upwardly of the other, thus allowing effective utilization of a dead space formed between the hydraulic cylinder and the boom.

Still preferably, a channel constituting member constituting said boom piping system is inserted through the inside of said each mast and connected to the boom cylinder attached to said mast; and a channel constituting member constituting said implement piping system is inserted through the inside of one of said masts and disposed along the boom pivotally supported to said mast.

With the above, the plurality of channel constituting members can be disposed in distribution on the right and left masts.

Still preferably, said channel constituting member constituting said implement piping system extends along a lower potion of said boom toward a leading end of said boom.

This allows effective utilization of the space downwardly of the boom.

According to a further characterizing feature of a load work apparatus relating to the present invention, the apparatus comprises:

first and second masts disposed erect on right and left sides of a vehicle body having a control valve;

a boom pivotally supported to said mast;

an implement detachably and pivotally supported to said boom;

an implement hydraulic cylinder for pivoting said implement; and an attachment piping system, said attachment piping system communicating said control valve with an attachment hydraulic actuator to be pivotally supported to said boom, in place of said implement;

wherein a channel constituting member constituting said attachment piping system extends vertically within said first mast; one end of said channel constituting member extends to the outside at a lower portion of said first mast to be connected with said control valve; and the other end of said channel constituting member extends to the outside at an upper portion of said first mast and extends toward a leading end of said boom.

With the above-described construction, the channel constituting member extending from the control valve is disposed through the inside of the mast to the loader. Therefore, there is eliminated the risk of this channel constituting member hindering the driver's front side view. Further, as this channel constituting member is protected within the mast, there is also no risk of the member being damaged through its collision with an obstacle or the like present on a lateral side of the vehicle body. Still further, as the channel constituting member is hidden inside the mast, the appearance of the entire loader work machine will be improved also.

In the above-described construction, preferably, said channel constituting member constituting said attachment piping system extends to the outside of the mast from between a boom pivot portion and a cylinder pivot portion and is disposed between said boom and said boom cylinder.

Also preferably, said boom cylinder includes a cylinder tube pivotally supported to said cylinder pivot portion and a piston rod pivotally supported to the boom cylinder and a boom piping system extending from said control valve to said boom cylinder extends through the inside of the mast to be connected to the cylinder tube pivotally supported to said mast.

With the above-described constructions, as the cylinder tube connected to the boom piping system is pivotally supported to the mast, there is no need of disposing the boom piping system along the boom from the leading end to an intermediate portion thereof. Then, in the free space created thereby between the boom and the boom cylinder, the channel constituting member for the attachment piping system can be disposed.

Further preferably, in the above-described construction, the channel constituting member constituting said attachment piping system is inserted through the inside of one of said masts and disposed along the boom pivotally supported to said mast; and the channel constituting member constituting said implement piping system is inserted through the inside of one or the other mast and disposed along the boom pivotally supported to said mast.

With the above-described construction, the channel constituting member for each piping system extends through the inside of the right and left masts and the control valve toward the hydraulic actuator and the implement cylinder. Hence, these plural channel constituting members are protected within the masts. Further, as the channel constituting members are disposed in distribution to the pair of right and left masts for the respective piping systems, the respective piping systems from the masts to the hydraulic actuator or the cylinder can be arranged neatly and compactly. Therefore, when either piping system, the hydraulic actuator, etc. is to be replaced, this piping system and e.g. the cylinder can be connected without confusion.

Further, the insides of the masts disposed on the right and left sides of the vehicle body can be effectively utilized as piping arranging space.

DESCRIPTION OF PREFERRED EMBODIMENTS

Embodiments of the present invention as applied to a work vehicle 1 will be described specifically with reference to the accompanying drawings.

Figure 8:
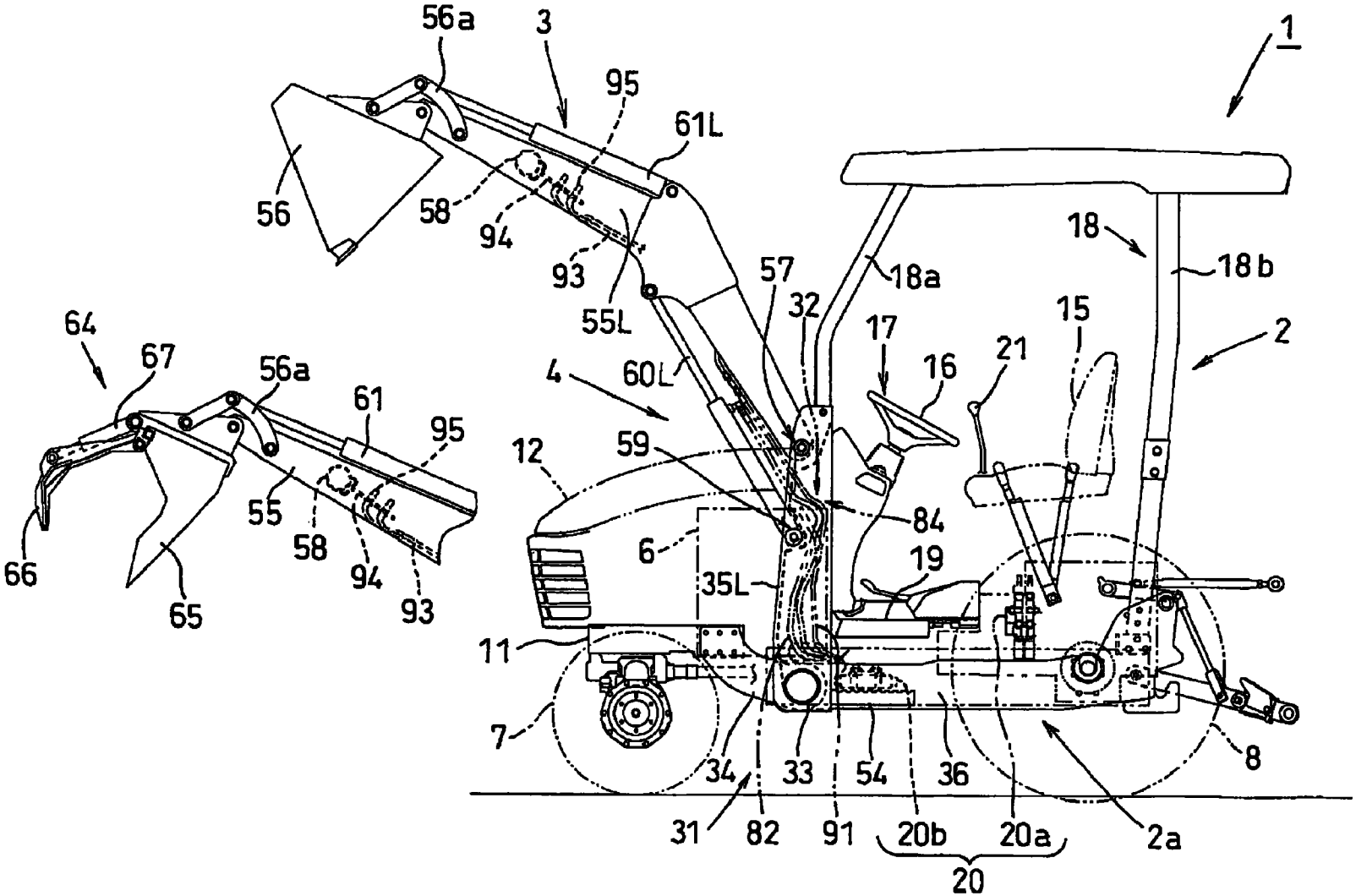
FIG. 8 is a left side view of a work vehicle.

As shown in FIG. 8, the work vehicle 1 is a so-called TLB (tractor-loader-backhoe) including a tractor 2, a loader work apparatus 4 capable of mounting a loader 3 to a front portion of the tractor 2 and a backhoe (not shown) attachable to a rear portion of the tractor 2.

A vehicle body 2*a* of the tractor 2 mounts an engine 6, a clutch housing connected to a rear portion of the engine 6 via e.g. a flywheel housing and a transmission case connected to a rear portion of the clutch housing and the vehicle body can travel by means of a pair of right and left front wheels 7 and a pair of right and left rear wheels 8.

To a front lower portion of the engine 6, there are fixedly attached, via fasteners such as bolts, a pair of right and left front axle frames 11 extending forwardly from the engine 6. Upon the front axle frames 11, there are mounted such vehicle components as a battery, a radiator, a fuel tank etc. And, these components, i.e. the engine 6, the battery, the radiator, the fuel tank, etc. are covered with a hood 12. To rear lower portions of the transmission case 10, there are attached a pair of right and left rear axle cases.

On right and left rear sides of the vehicle body 2*a*, there are provided rear wheel fenders for covering the inner sides of the rear wheels 8. And, between these right and left rear wheel fenders, there is provided a driver's seat 15. Forwardly of the driver's seat 15, there is provided an operating section 17 including a steering wheel 16.

Further, on the vehicle body 2*a*, there is mounted a four-strut type ROPS (Roll Over Protection Structure) 17 surrounding the driver's seat 15 and the operating section 17. The ROPS 18 includes a pair of right and left front struts 18*a* and a pair of right and left rear struts 18*b*.

Between front lower ends of the right and left rear wheel fenders, a floor seat 19 is disposed to project forwardly. This floor seat 19 extends to lower sides of the operating section 17 and the driver's seat 15.

The loader work apparatus 4 includes an implement mounting frame 31 attached to the vehicle body 2*a* and the loader 3 supported to this implement mounting frame 31.

Figure 6:
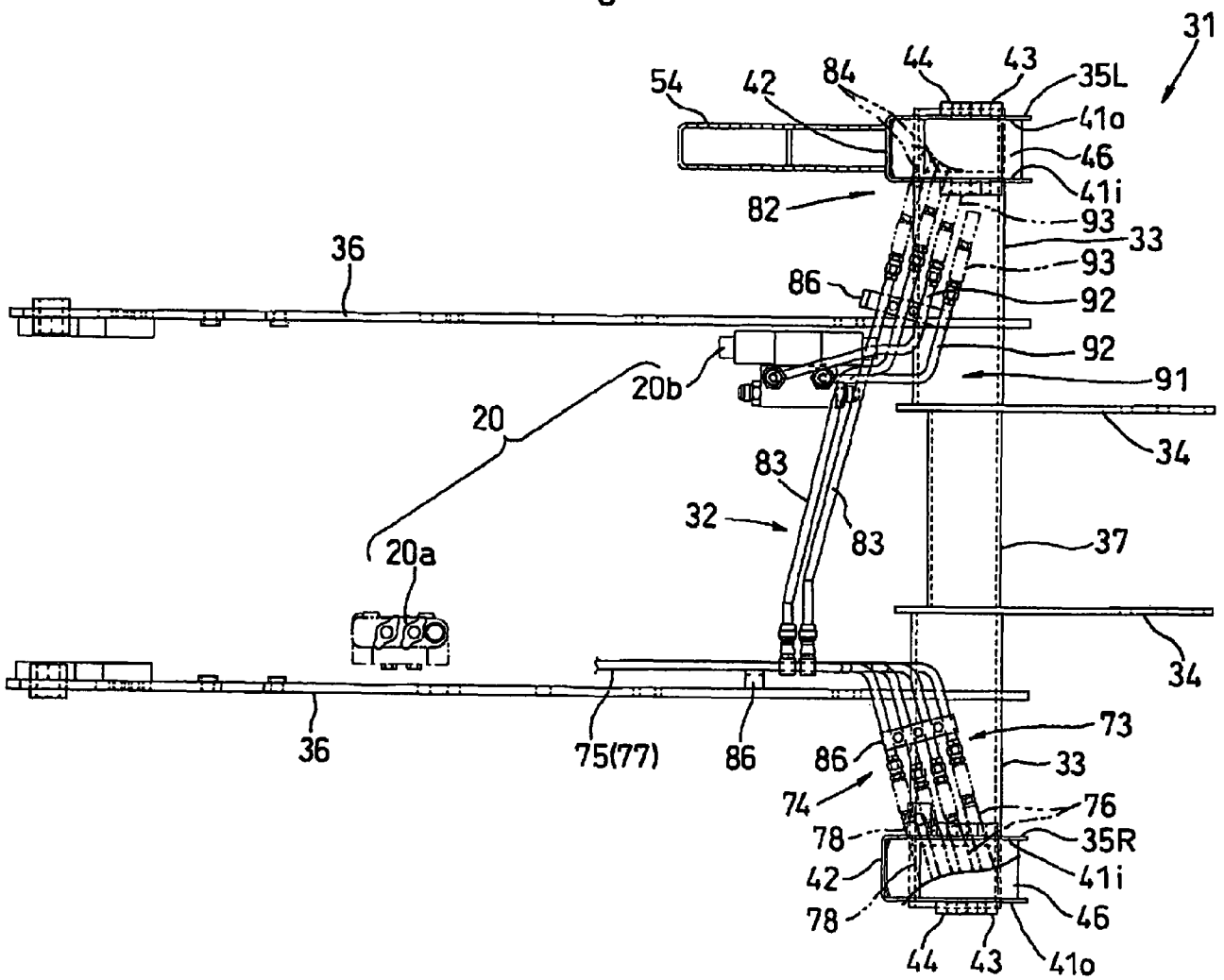
FIG. 6 is a plan view of the implement mounting frame.

As shown in FIG. 6 and FIG. 8, the implement mounting frame 31 includes support decks 33 provided on the front side of the vehicle body 2*a* and projecting outward in the right/left direction from the vehicle body 2*a*, attaching brackets 34 for fixedly attaching the support decks 33 to the vehicle body 2*a*, masts 35L, 35R supported erect on the support decks 33, and connecting frames 36 disposed on the lateral sides of the vehicle body 2*a* along the fore and aft direction, with these components all being provided in a pair on the right and left sides.

Figure 5:
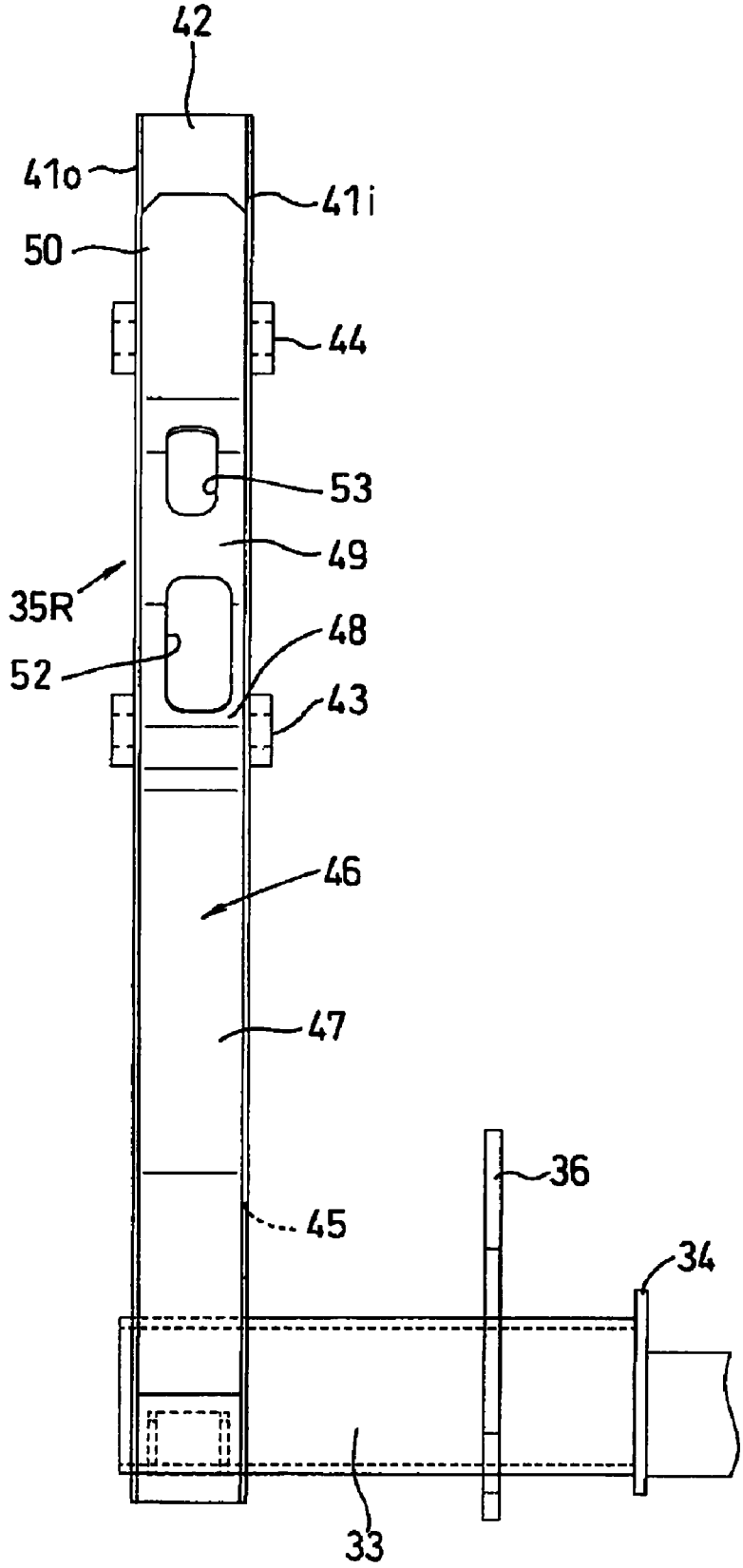
FIG. 5 is a front view of the right mast.

As shown in FIG. 5 and FIG. 6, the support deck 33 is formed of a cylindrical tubular member having an axis extending in the right/left direction. Further, to a right/left inner end of the support deck 33, the attaching bracket 34 is fixed by welding.

This attaching bracket 34 is formed of e.g. a plate member and extends forwardly beyond the support deck 33 and is fixedly attached to the vehicle body 2*a* portion, such as the front axle frame 11, via fasteners such as bolts. Further, the right and left pair of attaching brackets 34 are connected to each other via a connecting frame 37 and this connecting framework 37 is fixedly attached to the lower face of the vehicle body 2*a*.

Figure 2:
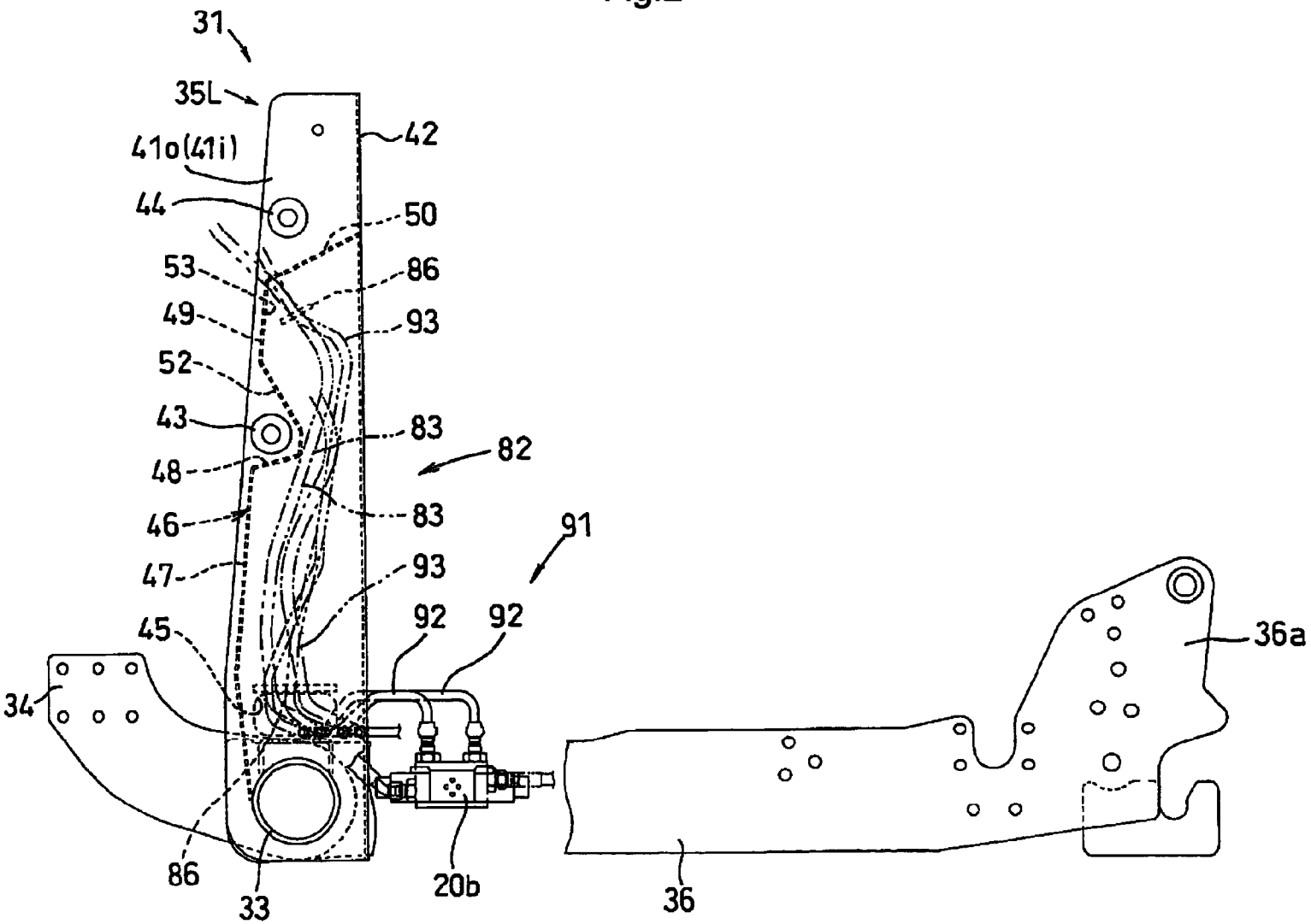
FIG. 2 is a left side view of an implement mounting frame.
Figure 4:
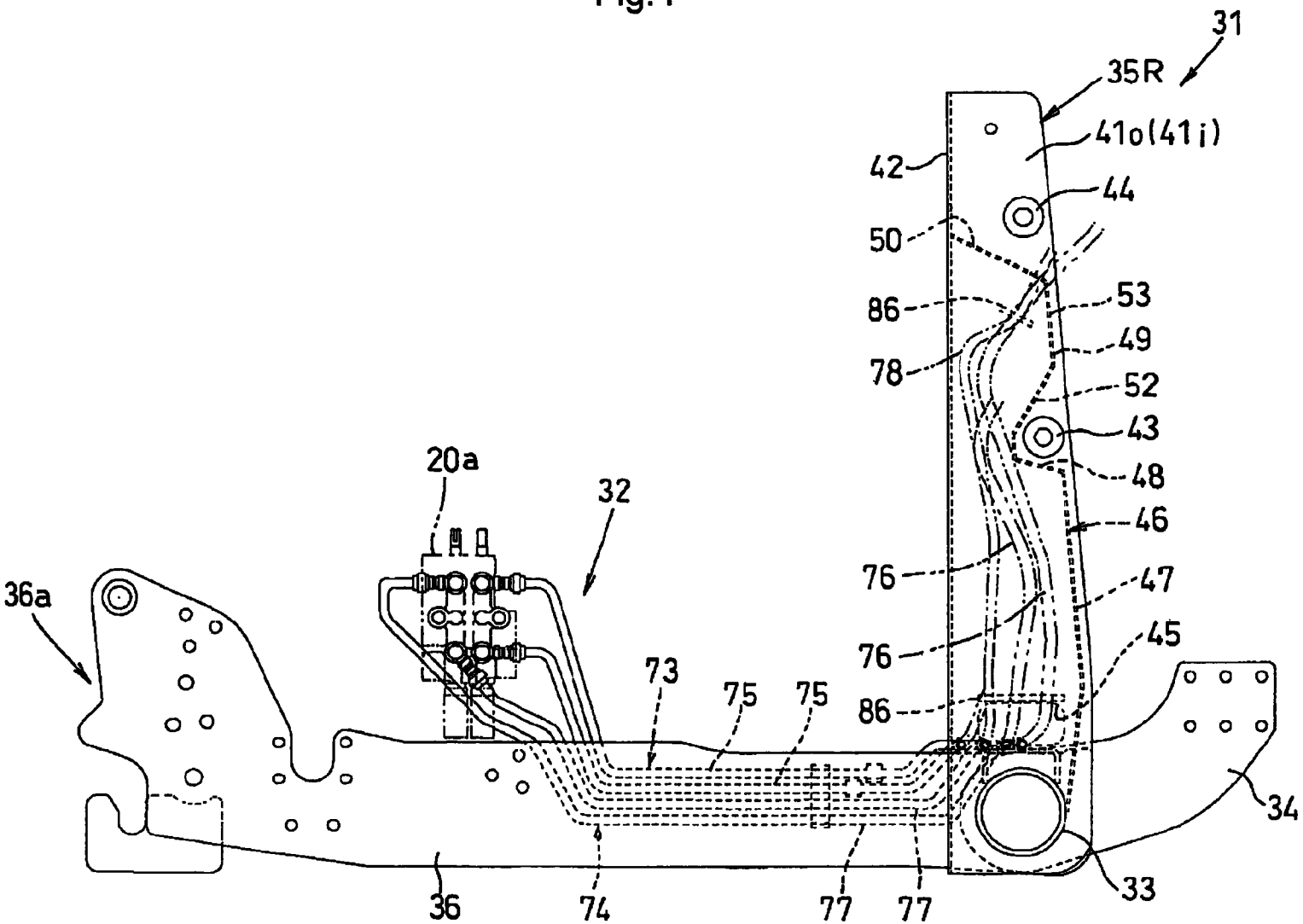
FIG. 4 is a right side view of the implement mounting frame.

Also, the pair of right and left connecting frames 36 are formed of elongate plate members and extend along the lower lateral sides of the vehicle body 2*a* from the front portion to the rear portion of this vehicle body 2*a*. The front portion of the connecting frame 36 is connected to a right/left intermediate portion of the support deck 33 and the rear portion of the connecting frame 36 is connected to a vehicle body 2*a* portion such as the rear axle case through fasteners such as bolts. Further, as shown in FIGS. 2 and 4, at the rear end of each connecting frame 36, there is provided a backhoe attaching portion 36*a* for detachably attaching a backhoe.

As shown in FIG. 5 and FIG. 6, the right mast 35R is mounted erect on the right/left outer end of the right support deck 33R. And, this mast 35R includes a pair of right and left side walls 41*i*, 41*o* formed by bending a plate member into an angular hooked shape, a rear wall 42, and a reinforcing wall 46 interconnecting front portions of the right and left side walls 41*i*, 41*o*. And, the mast 35R is formed like an angular tube with these right and left side walls 41*i*, 41*o*, the rear wall 42 and the reinforcing wall 46.

Further, on the front side of a vertically intermediate portion of the mast 35R, there are provided a first boss 43 extending along the right/left direction across the right and left pair of side walls 41*i*, 41*o* and a second boss 44 provided upwardly of the first boss 43 and extending along the right/left direction across the right and left pair of side walls 41*i*, 41*o*. Also, in the inner side wall 41, there is formed a first opening 45 at a position upwardly of the support deck 33.

The reinforcing wall 46 includes a first vertical wall portion 47 extending from the front portions of the support deck 33 supported to the right and left side walls 41*i*, 41*o* toward the first boss 43 along the front ends of the pair of right and left side walls 41*i*, 41*o*, a bent wall portion 48 bent from the upper end portion of the first vertical wall portion 47 and extending past the rear side of the first boss 43 to an upper portion of the first boss 43, a second vertical wall portion 49 extending from the upper end portion of the bent wall portion 48 toward the second boss 43 along the front ends of the right and left side walls 41*i*, 41*o* and an inclined wall portion 50 extending from the upper end portion of the second vertical wall portion 49 past the lower side of the second boss 44 to be connected to the rear wall 42.

The reinforcing wall 46 defines a second opening 52 extending from an upper portion of the bent wall portion 48 along the lower portion of the second vertical wall portion 49 and a third opening 53 extending from the upper portion of the second vertical wall portion 49 along the front portion of the inclined wall portion 50. With these, the second opening 52 and the third opening 53 are provided between the first boss 43 and the second boss 44 provided one being above the other.

The left mast 35L shown in FIG. 2 has an identical construction to the right mast 35R.

Further, as shown in FIG. 6 and FIG. 8, to the rear wall 42 of the left mast 35L, there is attached a step 53 projecting toward the rear side of the vehicle body 2*a*.

As shown in FIG. 8, the loader 3 includes a pair of right and left booms 55L, 55R pivotally connected to upper portions of the right and left masts 35L, 35R to be pivotable about a right/left axis and a bucket (implement) 56 pivotally connected to the front end portions of the right and left booms 55L, 55R to be pivotable about a right/left axis.

The base end portion (rear end portion) of the left boom 55L is pivotally supported to the left mast 35L to be pivotable about the right/left axis with a pin inserted into the second boss 44 defined in this left mast 35L. This pin and the second boss 44 together form a boom pivot portion 57 provided at an upper portion of the mast 35L.

Figure 3:
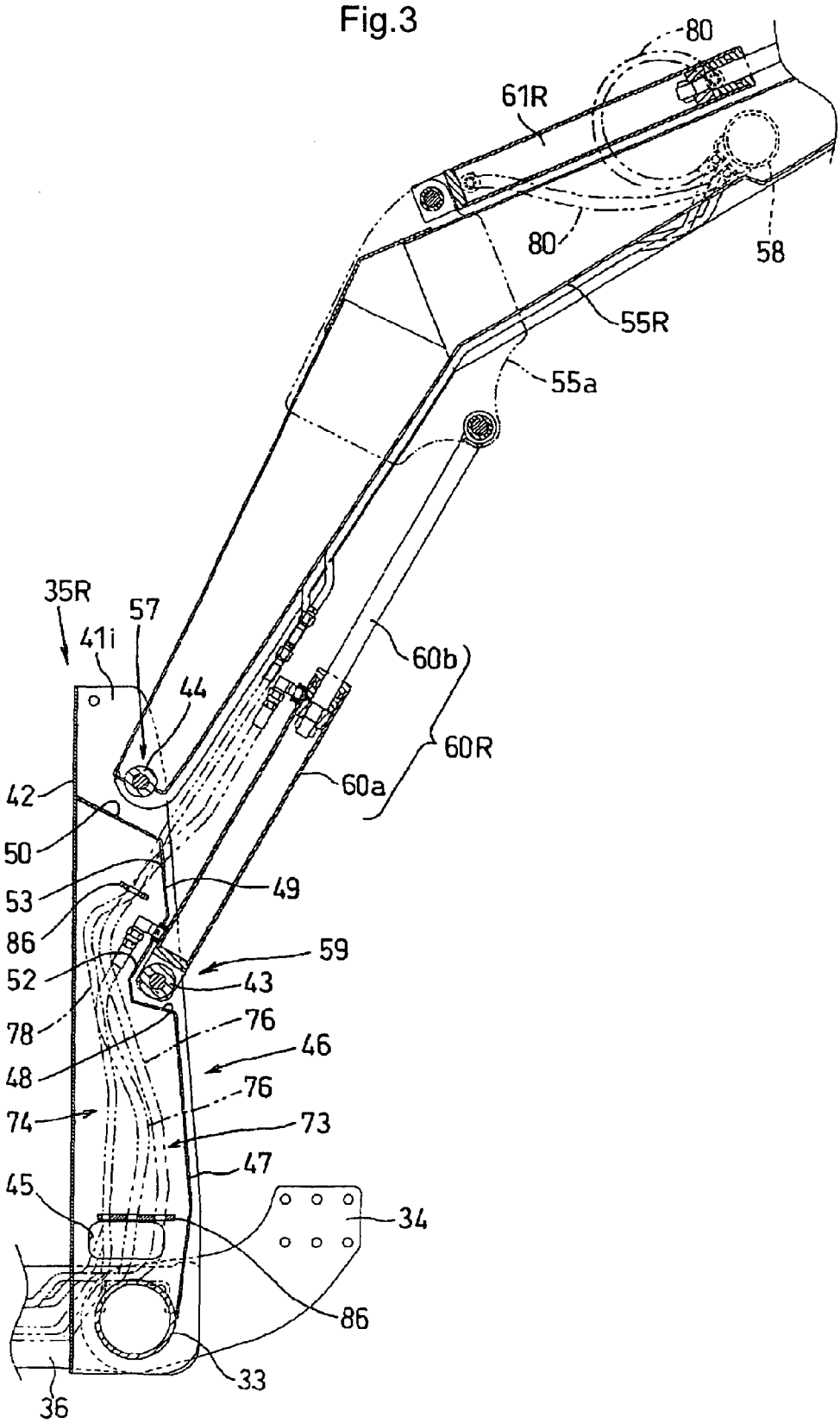
FIG. 3 is a right side section view showing a right mast and a boom.

Incidentally, the right boom 55R shown in FIG. 3 has an identical construction to the left boom 55L.

Figure 7:
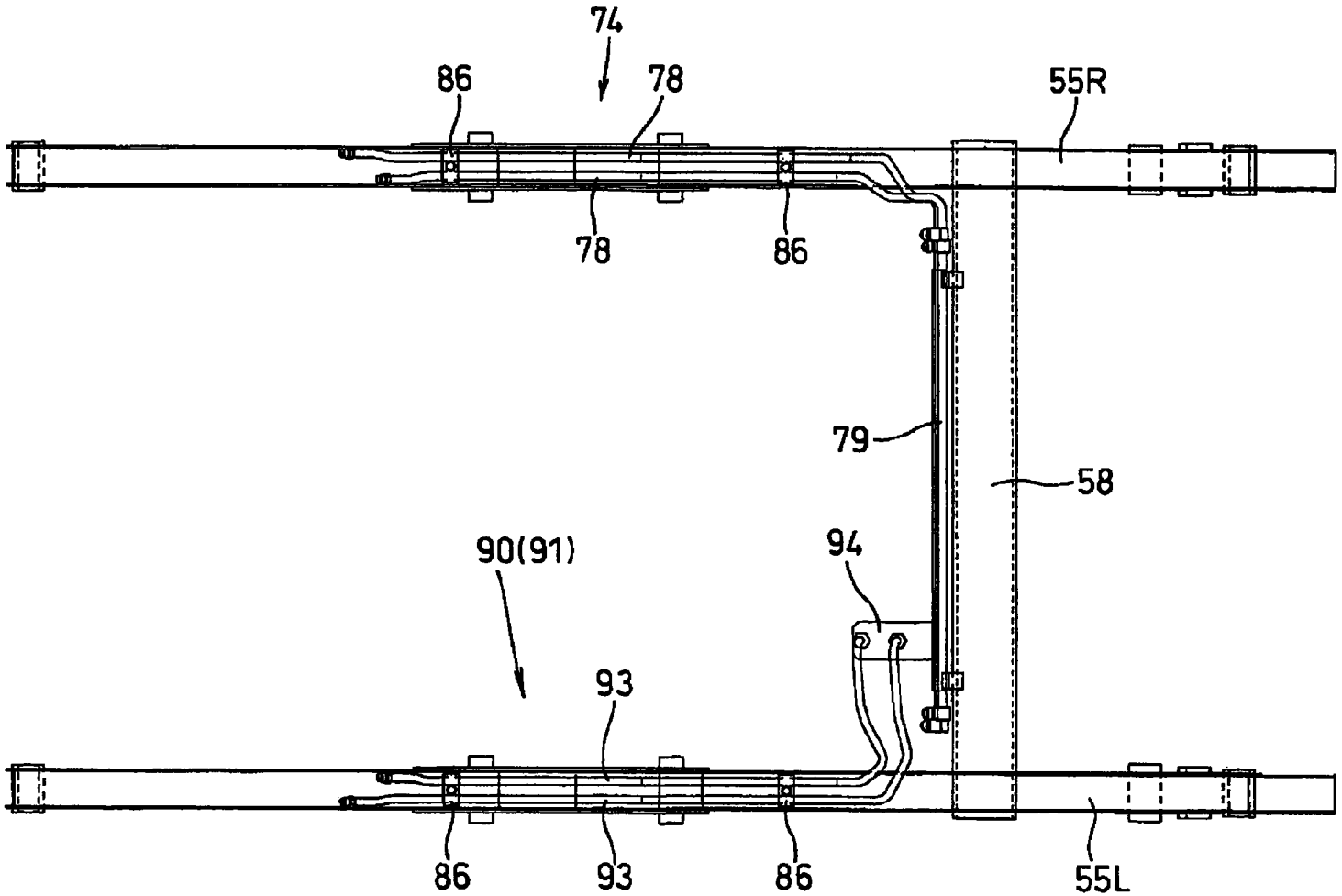
FIG. 7 is a bottom view of a boom.

Between and across the leading ends of the respective booms 55L, 55R, the bucket 56 is pivotally supported to be pivotable about the right/left axis. And, as shown in FIG. 7, intermediate portions of the right and left booms 55L, 55R are interconnected via a connecting pipe 58.

Figure 1:
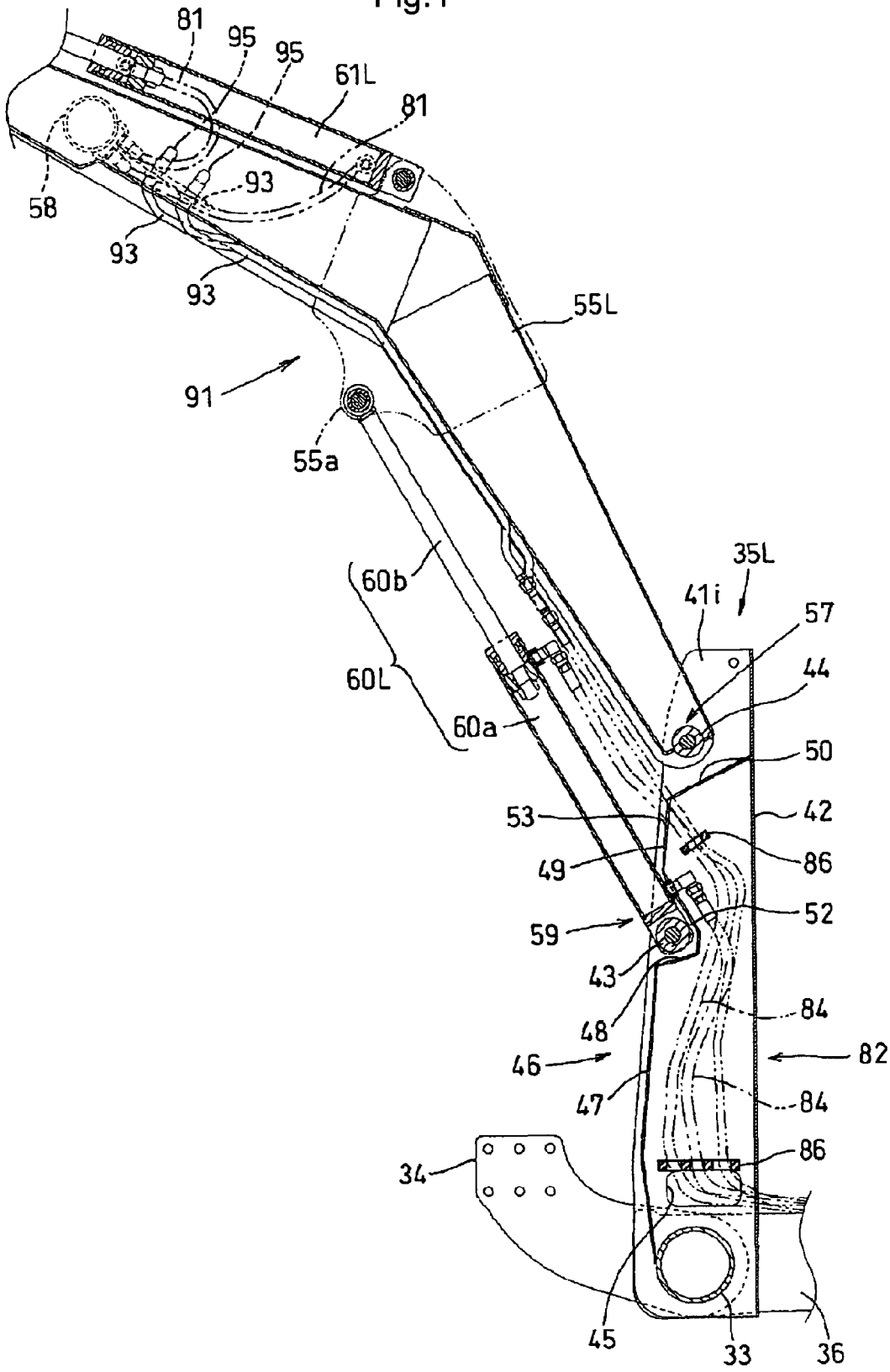
FIG. 1 is a left side section showing a left mast and a boom relating to an embodiment of the invention.

Further, as shown in FIG. 1, on the rear lower side of the left boom 55L, there is disposed a boom cylinder 60L interposed between this boom 55L and the mast 35L.

The boom cylinder 60L includes a cylinder tube 60*a*, and a piston rod 60*b* inserted in the cylinder tube 60*a* to be projectable and retractable relative thereto. The rear end portion of the cylinder tube 60*a* is pivotally supported via a pin to the first boss 43 of the mast 35L. Hence, this pin and the first boss 43 together constitute a cylinder pivot portion 59 provided at a position upwardly of the mast 35L and downwardly of the boom pivot portion 57.

Further, the front end portion of the piston rod 60*b* is pivotally supported via a pin to the bracket 55*a* provided at an intermediate portion of the boom 55L. In operation, as the piston rod 60*b* enters/exits the cylinder tube 60*a* thus expanding/contracting the boom cylinder 60L, the boom 55L is pivoted.

Further, on the front upper side of the boom 55L, there is provided a bucket cylinder (implement cylinder) 61L. The base end portion of this bucket cylinder 61L is pivotally supported to an intermediate portion of the boom 55L and at the leading end of the bucket cylinder 61L, the bucket 56 is connected via a pair of links 56*a*. Then, in association with expansion/contraction of the bucket cylinder 61L, the bucket 56 effects a scooping/dumping operation.

Incidentally, the construction of the boom cylinder 60R provided in the right boom 55R shown in e.g. FIG. 3, the construction of the boom 55R and the boom cylinder 60R being pivotally supported to the right mast 35R, the construction of the bucket 53 being pivotally supported to the boom 55R, and the construction of the bucket cylinder 61R are identical to those provided on the left side described above.

Further, at the leading ends of the two booms 55L, 55R, instead of the bucket 56 described above, an attachment driven by a hydraulic actuator can be disposed. In this embodiment, as an example of such attachment, a grapple 64 is illustrated in FIG. 8. This grapple 64 includes a bucket 65 pivotally supported to the leading ends of the booms 55L, 55R, a fork 66 pivotally supported to the bucket 65 and a fork cylinder (hydraulic actuator) 67 interposed between the fork 66 and the bucket 65 for pivoting the fork 66. Like the bucket 56 described above, the bucket 65 is pivoted by bucket cylinders 61L, 61R provided in the two booms 55L, 55R.

Incidentally, as shown in FIG. 6 and FIG. 8, the vehicle body 2*a* includes a control valve 20 for driving the loader 3. This control valve 20 includes a main control valve 20*a* for feeding pressure oil to the boom cylinders 60L, 60R and the bucket cylinders 61L, 61R of the loader 3 and a sub control valve 20*b* for feeding pressure oil to the fork cylinder 67 of the grapple 64 mounted in place of the bucket 56.

More particularly, the main control valve 20*a* is disposed under the driver's seat 15 and on the inner side of one rear wheel fender (right side in this embodiment). And, from this main control valve 20*a* to the right side of the driver's seat 15, there is extended a control lever 21 for operating a spool portion of the main control valve 20*a*.

Whereas, the sub control valve 20*b* is disposed downwardly of the floor seat 19 and attached to the loader 3 to the inner side of the one connecting frame 36 (the left side in this embodiment).

The loader work apparatus 4 includes a pressure oil communicating channel 32 for feeding pressure oil from the control valve 20 to the boom cylinders 60L, 60R and the bucket cylinders 61L, 61R of the loader 3 and the fork cylinder 67 of the grapple 64.

As shown in FIG. 6, the pressure oil communicating channel 32 includes a right boom piping system 73 extending from the main control valve 20*a* toward the right boom cylinder 60R, a left boom piping system 82 branched from an intermediate portion of the right boom piping system 73 and extending toward the left boom cylinder 60L, a bucket piping system (implement piping system) 74 extending from the main control valve 20*a* toward the bucket cylinder and an attachment piping system 91 extending from the sub control valve 20*b* toward a leading end of one boom (the left boom in this embodiment).

As shown in FIG. 3, FIG. 4 and FIG. 6, the right boom piping system 73 includes two conduits for feeding pressure oil to the right boom cylinder 60R. These paired conduits respectively include a pipe member 75 extending from the main control valve 20*a* along the right connecting frame 36 to the lower portion of the right mast 35R and a hydraulic hose 76 extending from the lower portion of this mast 35R to the right boom cylinder 60R.

The hydraulic hose 76 is connected to the pipe member 75 at the lower portion of the mast 35R and extends through the first opening 45 of the mast 35R to the inside of the mast 35R. Then, the hose extends upwards within this mast 35R. One hydraulic hose 76 extends to the outside of the mast 35R through the second opening 52 of the mast 35R and the other hydraulic hose 76 extends to the outside of the mast 35R through the third opening 53.

In the above, since the second opening 52 and the third opening 53 are disposed between the boom pivot portion 57 and the cylinder pivot portion 59, the hydraulic hose 76 within the mast 35R extends to the outside of the mast 35R from between the boom 55 and the boom cylinder 60. And, one hydraulic hose 76 is connected via an elbow or the like to the mast side end of the cylinder tube 60*a* of the boom cylinder 60R, whereas the other hydraulic hose 67 is connected via an elbow or the like to the piston rod side end of this cylinder tube 60*a*.

The bucket piping system 74 includes two conduits for feeding pressure oil to the pair of right and left bucket cylinders 61R, 61L. These paired conduits respectively include a pipe member 77 extending from the main control valve 20*a* along the connecting frame 36 to the lower portion of the right mast 35R and a hydraulic hose 78 extending from the lower portion of this mast 35R to the right bucket cylinder 61R.

The hydraulic hose 78 is connected to the pipe member 75 at the lower portion of the mast 35R and extends through the first opening 45 of the mast 35R to the inside of the mast 35R. Then, the hose extends upwards within this mast 35R and extends to the outside of the mast 35R through the third opening 53. With this, the hydraulic hose 78 within the mast 35R extends to the outside of the mast 35R from between the boom 55R and the boom cylinder 60R.

And, the hydraulic hose 78, after exiting the mast 35R, as shown in FIG. 7, extends further along the lower face of the right boom 55R to the connecting pipe 58. This connecting pipe 58 includes a pipe member 79 extending from the right end portion to the left end portion and the hydraulic hose 78 is connected to this pipe member 79 at the right end portion of the connecting pipe 58. Further, from opposed ends of this pipe member 79, hydraulic hoses 80, 81 extend separately. These hydraulic hoses 80, 81, as shown in FIG. 1 and FIG. 3, are connected respectively to the bucket cylinders 61L, 61R on the same respective sides.

As shown in FIG. 1, FIG. 2 and FIG. 6, the left boom piping system 82 includes two conduits for feeding pressure oil to the left boom cylinder 60L. These paired conduits include a pipe member 83 extending from an intermediate portion of the pipe member 75 of the right boom piping system 73 across the vehicle body 2*a* to the lower portion of the left mast 35L and a hydraulic hose 84 extending from the lower portion of the mast 35L to the boom cylinder 60L.

The hydraulic hose 84 is connected to the pipe member 83 at the lower portion of the left mast 35L. and extends through the first opening 45 to the inside of the mast 35L. Then, the hose extends upward within the mast 35L and one hydraulic hose 84 extends to the outside of the mast 35L through the second opening 52 of the mast 35L and the other hydraulic hose 84 extends to the outside of the mast 35L through the third opening 53. With these, the hydraulic hose 84 within the mast 35L exits this mast 35L from between the left boom 55L and the boom cylinder 60L to be connected to the cylinder tube 60*a* of the boom cylinder 60L.

Further, the attachment piping system 91 includes two conduits for feeding pressure oil to the fork cylinder 67 of the grapple 64 in case this grapple 64 is mounted to the leading ends of the booms 55L, 55R, instead of the bucket 56. These paired conduits respectively include a pipe member 92 extending from the sub control valve 20*b* to the lower portion of the left mast 35L and a hydraulic hose 93 extending from the lower portion of the mast 35L to the front portion of the left boom 55L.

The hydraulic hose 93 is connected to the pipe member 92 at the lower portion of the mast 35L and then extends through the first opening 45 to the inside of the mast 35L. Then, the hose extends upward within the mast 35L and extends to the outside of the mast 35L through the third opening 53 defined in the mast 35L. With this, the hydraulic hose 93 extends to the outside of the mast 35L from between the boom 55L and the boom cylinder 60L.

After exiting the mast 35L, the hydraulic hose 93, as shown in FIG. 7, extends along the lower face of the left boom 55L to the connecting pipe 58. The connecting pipe 58 includes a bracket 94 projecting from the vicinity of the left end of the pipe member 79 included in the connecting pipe 58 to the rear side of the loader 3. And, the leading end of the hydraulic hose 93 extends through from the lower side to the upper side of the bracket 94 and is supported in this way to the bracket 94. In this, as the supporting positions of the two hydraulic hoses 93 to the bracket 94 are offset from each other in the fore and aft direction as illustrated in FIG. 7, vertical overlapping of the two hydraulic hoses 93 at their intermediate portions extending from the boom 55L and the bracket 94 is avoided, thus avoiding disadvantageous increase in the volume thereof Further, as shown in FIG. 1 and FIG. 8, to the leading end of each hydraulic hose 93 projecting from the bracket 84, there is attached a coupler 95. As the fork cylinder 67 of the grapple 64 is connected via this coupler 95 to the hydraulic hose 93, pressure oil can be fed from the sub control valve 20*b* to this fork cylinder 67, whereby the fork 66 of the grapple 64 can be pivoted.

Figure 9:
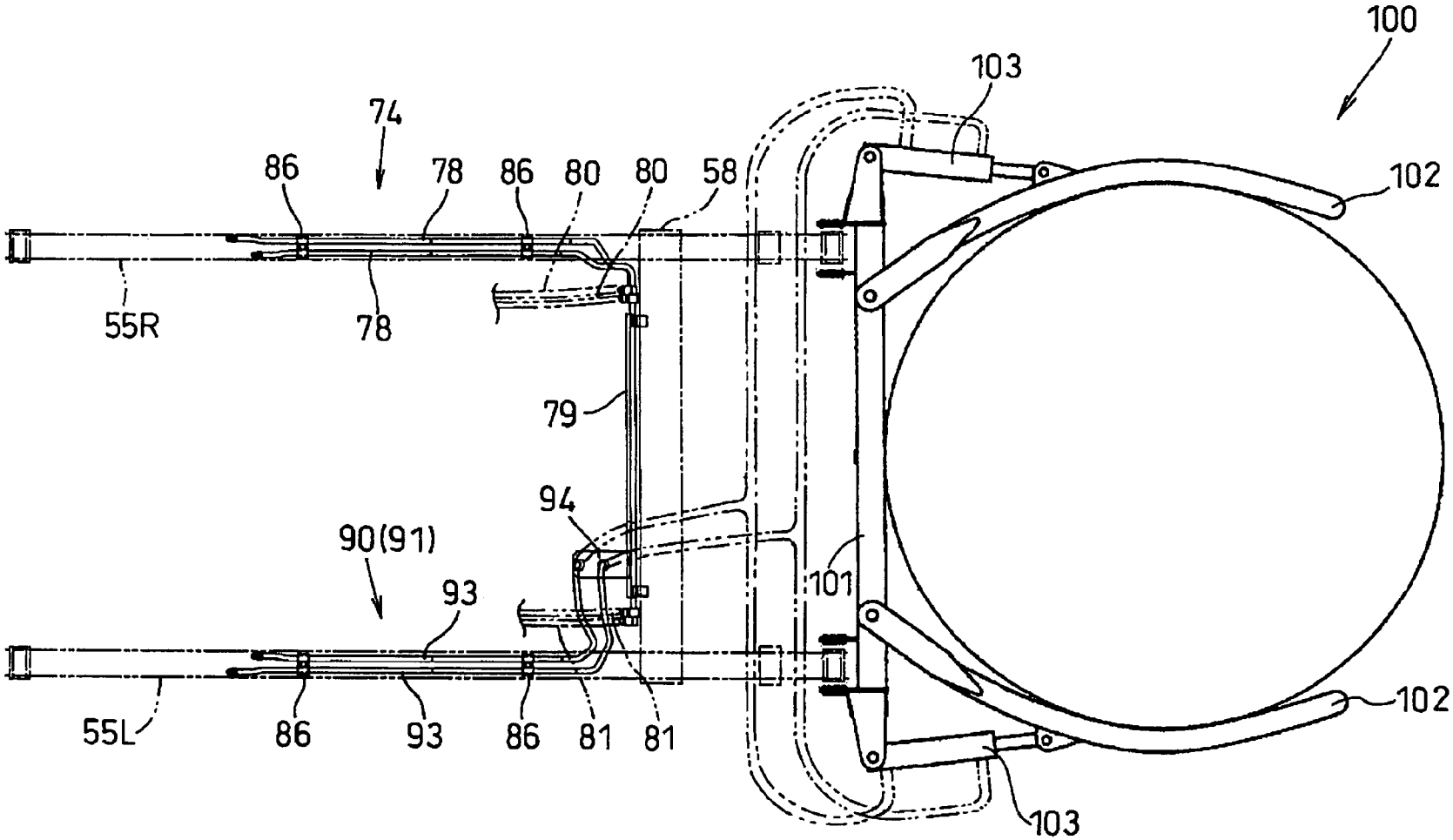
FIG. 9 is a bottom view of a roll grab and a boom.

Moreover, in the work vehicle 1 relating to this embodiment, a roll grab 100 shown in FIG. 9 can be used, as an attachment in place of the bucket 56 or the grapple 64 described above. This roll grab 100 includes a base portion 101 pivotally supported to the leading ends of the two booms 55L, 55R, a pair of right and left curved arms 102 pivotally supported to the base portion 101 and a pair of right and left arm cylinders 103 interposed between the right and left curved arms 102 and the base portion 101 for pivoting the right and left curved arms 102.

When this roll grab 100 is mounted, the piping system is branched from an intermediate portion thereof from the coupler 95 attached to the leading end of the hydraulic hose 93 to the right and left pair of arm cylinders 103, whereby the pair of right and left arm cylinders 103 are driven in synchronism with each other.

Incidentally, the respective piping systems 73, 74, 82, 91 are fixed via a plurality of clamping members 86 or fasteners to the connecting frame 36, the masts 35L, 35R, the booms 55L, 55R and the connecting pipe 58.

According to this embodiment, the hydraulic hoses 76, 78, 84, 93 forming intermediate portion of the respective piping systems 73,74, 82, 91 are disposed from the vehicle body side through the insides of the masts 35 to the loader side. Therefore, these hydraulic hoses 76, 78, 84, 93 are protected respectively by the masts 35. As a result, there will occur no hitting or friction of these hydraulic hoses 76, 78, 84, 93 with an obstacle present on the lateral side of the vehicle body.

Moreover, as the cylinder tubes 60*a* of the respective boom cylinders 60L, 60R are pivotally supported to the masts 35L, 35R and the hydraulic hoses 76, 84 are connected to the cylinder tubes 60*a*, there will hardly occur displacement of the connecting portion between the hydraulic hose 76, 84 and the cylinder tube 60*a* back and forth along the expanding/contracting direction of the piston rod 60*b* when this piston rod 60*b* is expanded/contracted. For this reason, it suffices to provide the hydraulic hose 76, 84 with an amount of play which allows the hose to follow the pivotal movement of the boom cylinder 60L, 60R. And, with such reduction in the additional length of the hydraulic hose 86, 84 required for the play, these hydraulic hoses 76, 84 can be compactly accommodated within the masts 35L, 35R.

Further, with the above-described layout of the right and left boom piping systems 73, 82, there is no need for disposing the boom piping system between the respective boom and the boom cylinder, as is the case with the conventional construction. Hence, there is created free space between the respective boom and the boom cylinder. Then, in the present embodiment, from between the boom pivot portion 57 and the cylinder pivot portion 59 of the right mast 35R, the hydraulic hose 76 is extended to the outside of the mast 35. Also, within the space created between the right boom 55R and the right boom cylinder 60R, the bucket piping system 74 is disposed. And, from between the boom pivot portion 57 and the cylinder pivot portion 59 of the left mast 35L, the hydraulic hose 84 is extended to the outside of the mast 35L. And, within the space created between the left boom 55L and the left boom cylinder 60L, the attachment piping system 91 is disposed. With these the spaces are effectively utilized.

More particularly, in the case of the standard condition (standard attachment condition) with the bucket 56 being attached to the leading ends of the booms 55L, 55R described above, there is formed the free space between the left boom 55L and the boom cylinder 60L. Then, in this embodiment, the attachment piping system 91 can be disposed within this space, thus effectively utilizing this space.

Further, in this embodiment, the two boom piping systems 73, 74 are disposed along the right mast 35R and the right boom 55R and the attachment piping system 91 is disposed along the left mast 35L and the boom 55L. Further, the bucket piping system 74 and the attachment piping system 91 are branched at the leading end of the booms. Therefore, in the areas around the masts 35L, 35R or the connecting pipe 58, the hydraulic hoses 76, 78, 84, 93 or the pipe members 75, 77, 83, 62 constituting these piping systems 73, 84, 82, 91 will not be present in bundle of five or more, and the respective piping systems 73, 84, 82, 91 can be arranged neatly and compactly at the front portion of the vehicle body 2*a*.

Further, even at such areas where four of the hydraulic hoses 76, 78, 84, 93 are present in a bundle, most of them are accommodated within the right and left masts 35L, 35R. Therefore, there will not occur the front view for the driver seated at the driver's seat 15 being hindered by such bundle of hydraulic hoses. And, sufficient front view is ensured and the appearance of the work vehicle 1 as a whole too is improved.

Moreover, as the bucket piping system 74 and the attachment piping system 91 are disposed in distribution, it is possible to dismount one piping system without having to dismount the other piping system. Further, there will occur no error in the removal of the piping system or connection thereof with the bucket cylinder 61L, 61R or the fork cylinder 67. With these, the replacement operations of these piping systems is facilitated.

Also, as the bucket piping system 74 and the attachment piping system 91 are disposed between the boom cylinders 60R, 60L and the booms 55L, 55R, the hydraulic hoses 78, 93 can be protected by the booms 55L, 55R against any sand or earth dropped during a loading operation thereof Consequently, it is possible to restrict damage to the hydraulic hoses 78, 93 due to collision with such sand or earth.

The present invention is not limited to the embodiment detailed above. For instance, in the foregoing embodiment, e.g. the left mast 35L is to accommodate four hydraulic hoses. Instead, it is also possible to have only some of them accommodated within the left mast 35L, while disposing the others on the outer or inner side of the mast 35L. In such modified construction too, substantially same advantageous effect can be achieved.

Further, even if the bucket piping system 74 and the attachment piping system 91 are disposed in reverse relative to each other, substantially same effect as that of the foregoing embodiment can be achieved. Moreover, it is also possible to insert either one of the bucket piping system 74 and the attachment piping system 91 in either one mast and disposed along the boom pivotally supported to this mast.

Further, more than two, e.g. four or six, conduits can be included in the attachment piping system 91 and pressure oil can be supplied to a plurality of hydraulic actuators which are operated not synchronism.

The vertical relative positions of the boom 55 and the boom cylinder 60 can be reversed from each other.

The main control valve 20*a* and the sub control valve 20*b* can be formed into one integral valve unit.

Further, in the construction of the present embodiment, the sub control valve 20*b* and the attachment piping system 91 can be attached (retro-fit) as options to a loader work vehicle having the bucket 56 attached to the leading ends of the booms 55L, 55R as the standard attachment.

Furthermore, the work vehicle 1 can be a loader work machine having a front loader mounted to a front portion of the tractor 5.

FURTHER EMBODIMENT

A further embodiment of the present invention will be described with reference to the accompanying drawings.

Figure 10:
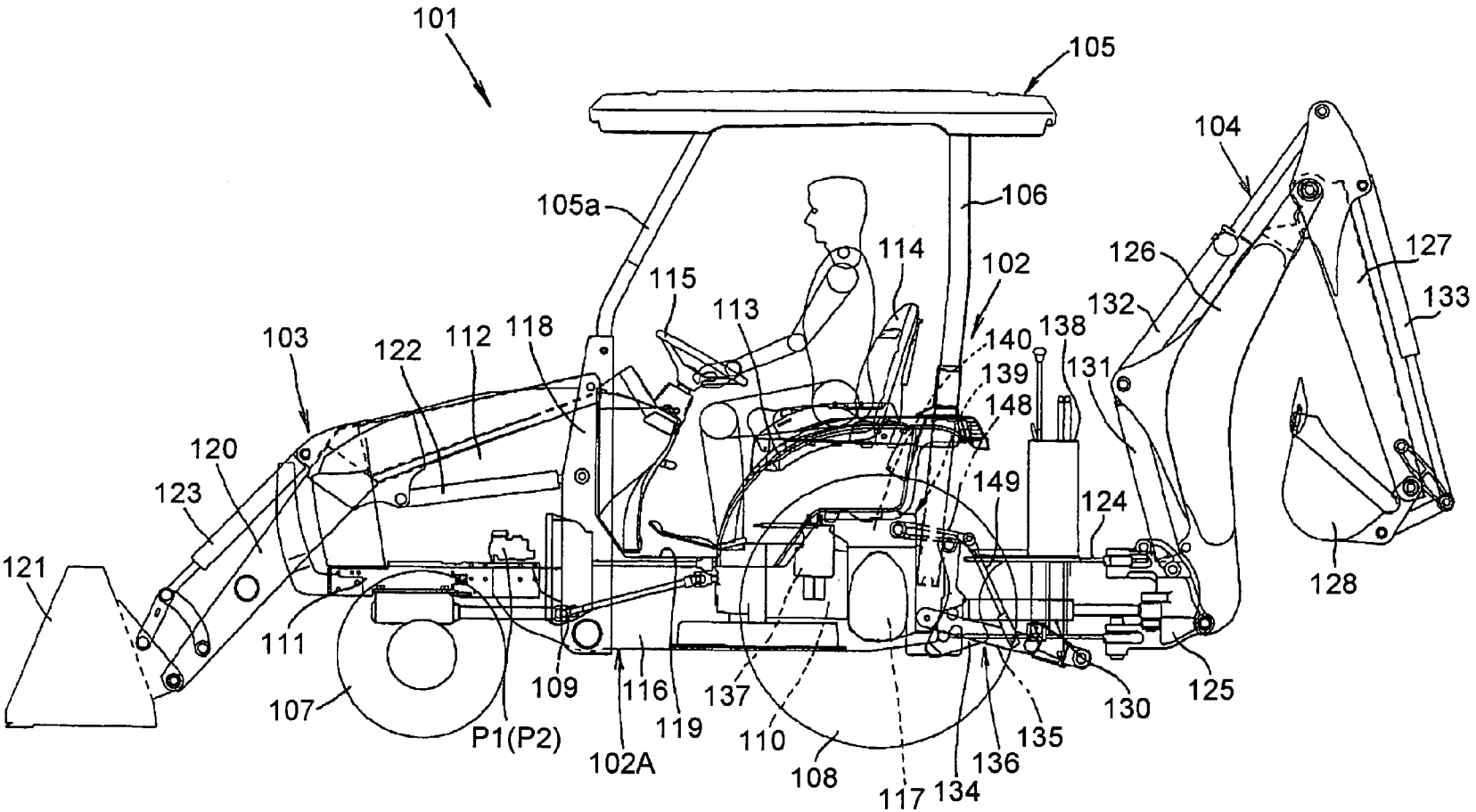
FIG. 10 is a side view of a work vehicle relating to a further embodiment.
Figure 11:
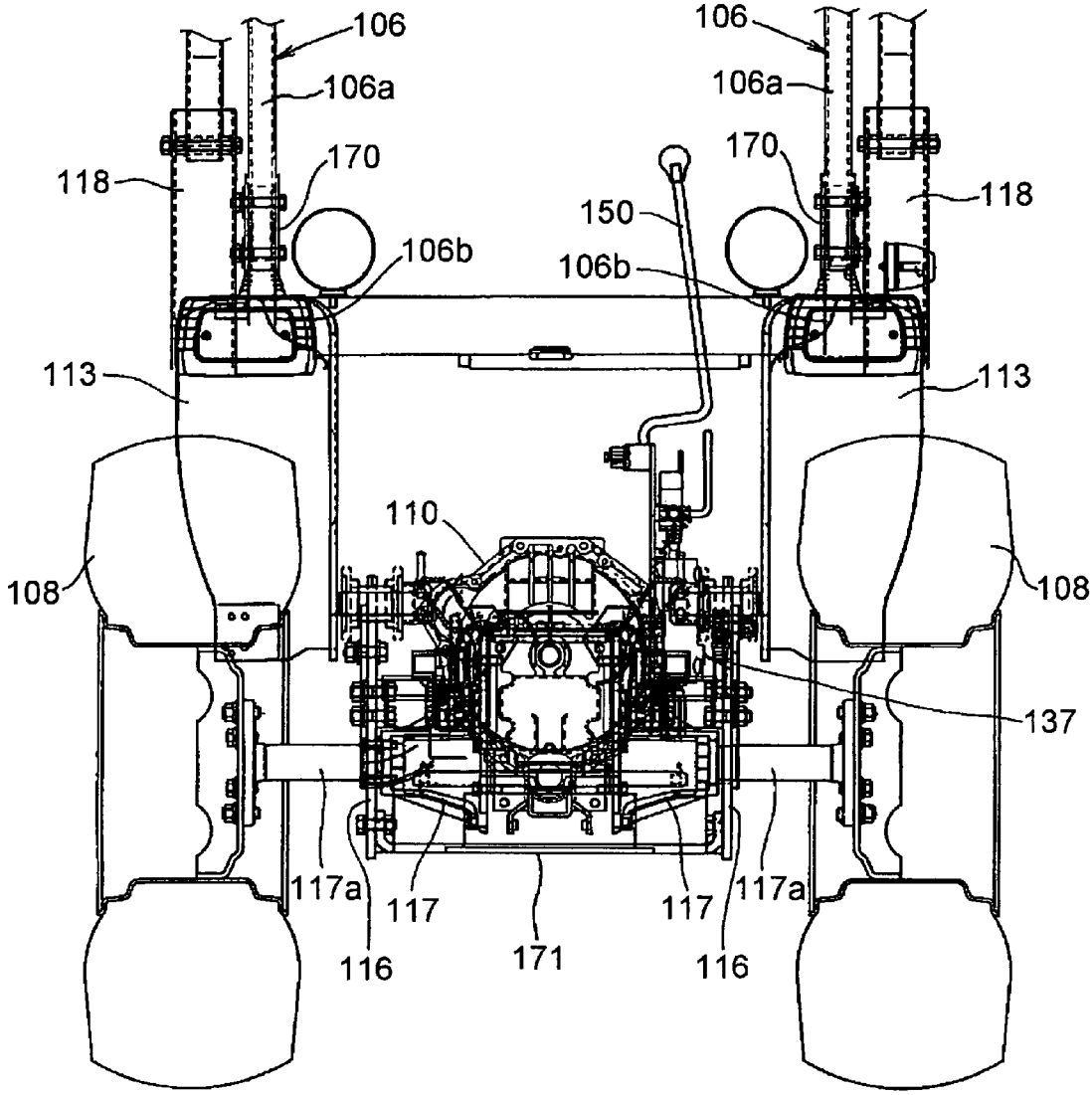
FIG. 11 is a rear view of the work vehicle relating to the further embodiment.
Figure 12:
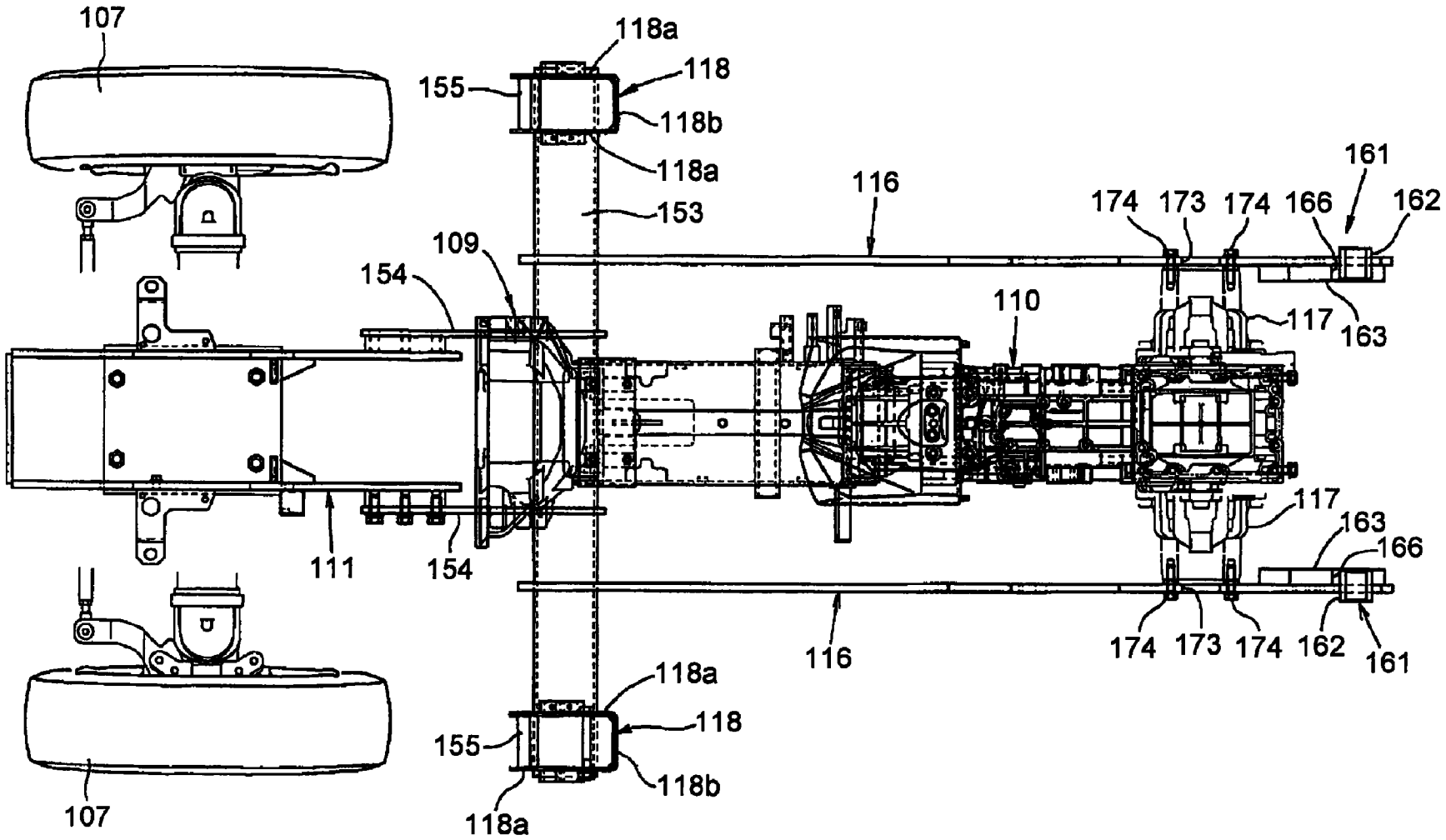
FIG. 12 is a plan view of a tractor vehicle body and an implement mounting frame portion relating to a further embodiment.

In FIGS. 10 and 11, numeral 101 denotes a work vehicle commonly called TLB (tractor-loader-backhoe) including a tractor 102, a front loader 103 attachable to a front portion of the tractor 102 and a backhoe 104 attachable to a rear portion of the tractor 102.

A vehicle body 2A of the tractor 102 mounts an engine, a clutch housing 109 connected to a rear portion of the engine via e.g. a flywheel housing and a transmission case 110 connected to a rear portion of the clutch housing 109 and the vehicle body can travel by means of a pair of right and left front wheels 107 and a pair of right and left rear wheels 108.

To a front lower portion of the engine, there are fixedly attached, via fasteners such as bolts, a pair of right and left front axle frames 111 extending forwardly from the engine. Upon the front axle frames 111, there are mounted such vehicle components as a battery, a radiator, a fuel tank etc. And, these components, i.e. the engine, the battery, the radiator, the fuel tank, etc. are covered with a hood 112.

On right and left rear sides of the tractor vehicle body 102A, there are provided rear wheel fenders 113 for covering the inner sides of the rear wheels 108. And, between these right and left rear wheel fenders 113, there is provided a driver's seat 114. Forwardly of the driver's seat 114, there is provided a steering wheel 115. Further, on the tractor vehicle body 102A, there is mounted a four-strut type ROPS (Roll Over Protection Structure: protective frame) 105 surrounding the driver's seat 114 and the steering wheel 115. The ROPS 105 includes a pair of right and left front struts 105*a* and a pair of right and left rear struts 106. Incidentally, in place of this ROPS 105, a canopy or the like may be employed.

Between front lower ends of the right and left rear wheel fenders 103, a floor seat 119 is disposed to project forwardly. This floor seat 119 extends to lower sides of the steering wheel 115 and the driver's seat 114.

On the right and left opposed sides of the tractor vehicle body 102A, there are disposed implement mounting frames 116 along the fore and aft direction for allowing mounting of the front loader 103 and the backhoe 104 to the tractor 102. And, as will be described later, these right and left implement mounting frames 116 are connected to each other and have their front portions fixed to rear portions of the front axle frames 111 and have their rear portions fixed to the rear axle frames 117 rearwardly of the transmission case 110. The rear axle cases 117 are provided as a right and left pair, rearwardly of the transmission case 110. And, each rear axle case 117 includes a projecting shaft portion 117*a* projecting outward in the right/left direction.

Further, to the front portion of each right/left implement mounting frame 116, a loader attaching member 118 is fixed as an upward projection therefrom.

The front loader 3 is detachably attached to each one of the right and left loader attaching members 118. The front loader 103 includes a boom 20 pivotally connected to an upper portion of the loader attaching member 118 to be pivotable about a right/left axis and a bucket 121 pivotally connected to a front end of the right/left boom 120 to be pivotable about a right/left axis.

The boom 120 is vertically pivoted in association with expansion/contraction of a boom cylinder 122 interposed between the loader attaching member 118 and the boom 120. The bucket 121 is operated for a scooping/dumping operation in association with expansion/contraction of a bucket cylinder 123 interposed between the boom 120 and the bucket 121.

The backhoe 104 includes a base 124 detachably attached to rear portions of the right and left implement mounting frames 116, a pair of right and left attaching bodies 134 fixed to a front portion of the base 124, a swing bracket 25 supported to a rear portion of the base 124 to be pivotable to the right or left about a vertical axis, a boom 126 connected to a lower portion side of the swing bracket 125 to be pivotable about a right/left axis, an arm 127 pivotally connected to a leading end side of the boom 126 to be pivotable about a right/left axis, a bucket 128 pivotally connected to a leading end side of the arm 127 and a pair of outriggers (not shown) disposed on the right and left opposed sides of the base 124.

The swing bracket 125 is pivoted vertically in association with an expanding/contracting movements of a pair of right and left swing cylinders 130 interposed between the base 124 and the swing bracket 125. The boom 126 is pivoted vertically in association with an expanding/contracting movement of a boom cylinder 131 interposed between the swing bracket 125 and the boom 126. The arm 127 is pivoted vertically in association with an expanding/contracting movement of an arm cylinder 132 interposed between the boom 126 and the arm 127. The bucket 128 is pivoted vertically for a scooping/dumping operation in association with an expanding/contracting movement of a bucket cylinder 33 interposed between the bucket 128 and the arm 127. The right and left outriggers are vertically pivoted respectively by a pair of right and left outrigger cylinders interposed between the outriggers and the base 124.

To a rear portion of the tractor vehicle body 102A, it is possible to attach a three-point link 136 consisting of one unillustrated top link disposed at the right/left center portion and a pair of lower right and left lower links 35. Hence, with the backhoe 104 dismounted therefrom, such rear implements as a box scraper (ground leveling implement), a rotary plow, etc. can be attached via this three-point link 136 to the rear portion of the tractor vehicle body 102A to be lifted or lowered relative thereto.

At the rear portion of the tractor vehicle body 102A, there is provided a hydraulic lift device 139 for vertically pivoting the lower links 135 of the three-point link 136, thus lifting or lowering the rear implement. This hydraulic lift device 139 includes an implement lifting/lowering hydraulic cylinder 140 which includes a pair of right and left lift arms 148.

The leading end (rear portion) of each lift arm 148 is connected via a lift rod 149 to the lower link 135 which is on the same right/left side. In operation, if the lift arms 148 are pivoted upward, the right and left lift rods 149 are raised, thus pivoting the right and left lower links 135 upward. With this, the rear implement attached to the three-point ink 136 is lifted up.

As shown in FIG. 10 and FIG. 11, on the right/left inner side of the pair of rear wheel fenders 113, there is provided a loader control valve 137. And, on the right side of the driver's seat 114, there is provided a control lever 150 for operating a spool portion of the loader control valve 137.

In FIGS. 12 through 16, the right and left implement mounting frames 116 are formed of a single plate member and to front portions of each right/left implement mounting frame 116, a support deck 153 formed of a cylindrical body having a right/left axis extends therethrough in the right/left direction and is fixed thereto by welding. Via the support decks 153, front portions of the right and left implement mounting frames 116 are connected to each other. On the right/left inner side of each right/left support deck 153, there is fixed attached, by e.g. welding, an attaching bracket 154 projecting forwardly and upwardly therefrom.

Further, a front portion of the attaching bracket 154 is disposed on a right/left outer side of the front axle frame 111 and fixedly attached to this front axle frame 111 by e.g. bolts.

Figure 17:
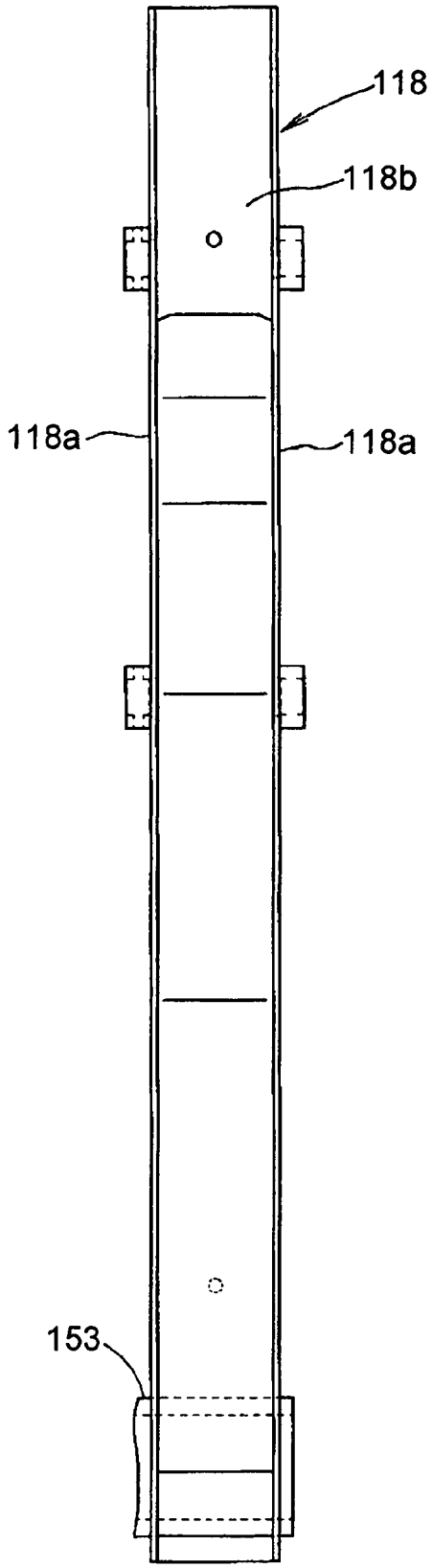
FIG. 17 is a front view of a loader attaching member according to a further embodiment.

At front portions of the right and left implement mounting frames 116, there are provided a pair of right and left loader attaching members 118 for detachably attaching the loader 103. Each of these right and left loader attaching members 118, as shown also in FIG. 17, includes a pair of right and left side walls 118*a* an and a rear wall 118*b* interconnecting rear edges of the right and left side walls 118*a* together, thus presenting an angular hooked shape open to the front in its plan view.

The loader attaching members 118 are disposed on the right and left opposed sides of the engine and on right and left outer sides of the front portions of the implement mounting frames 116. The right and left outer ends of the support decks 153 extend through lower ends of the right and left side walls 118*a* and the right and left side walls 118*a* are fixed to the support decks 153 by e.g. welding. The loader members 118 are fixed to the support decks 153 to project upwardly therefrom.

To an upper end of the loader attaching member 118, a lower end of the front strut 105*a* of the ROPS 105 is inserted and fixedly attached by means of a pin or a bolt.

Between the right and left side walls 118*a* of the loader attaching member 118, there is provided a reinforcing plate 155 extending from an upper portion to a lower portion thereof.

To the rear end of each right/left implement mounting frame 116, there is provided a backhoe attaching portion (implement attaching portion) 161 for detachably attaching the backhoe 104 thereto.

The backhoe attaching portion 161 includes a connecting portion 162 provided at a rear end upper portion of the implement mounting frame 116 and a receiving member 163 provided, as a rearward projection, at a rear end lower portion of the implement mounting frame 116.

Figure 16:
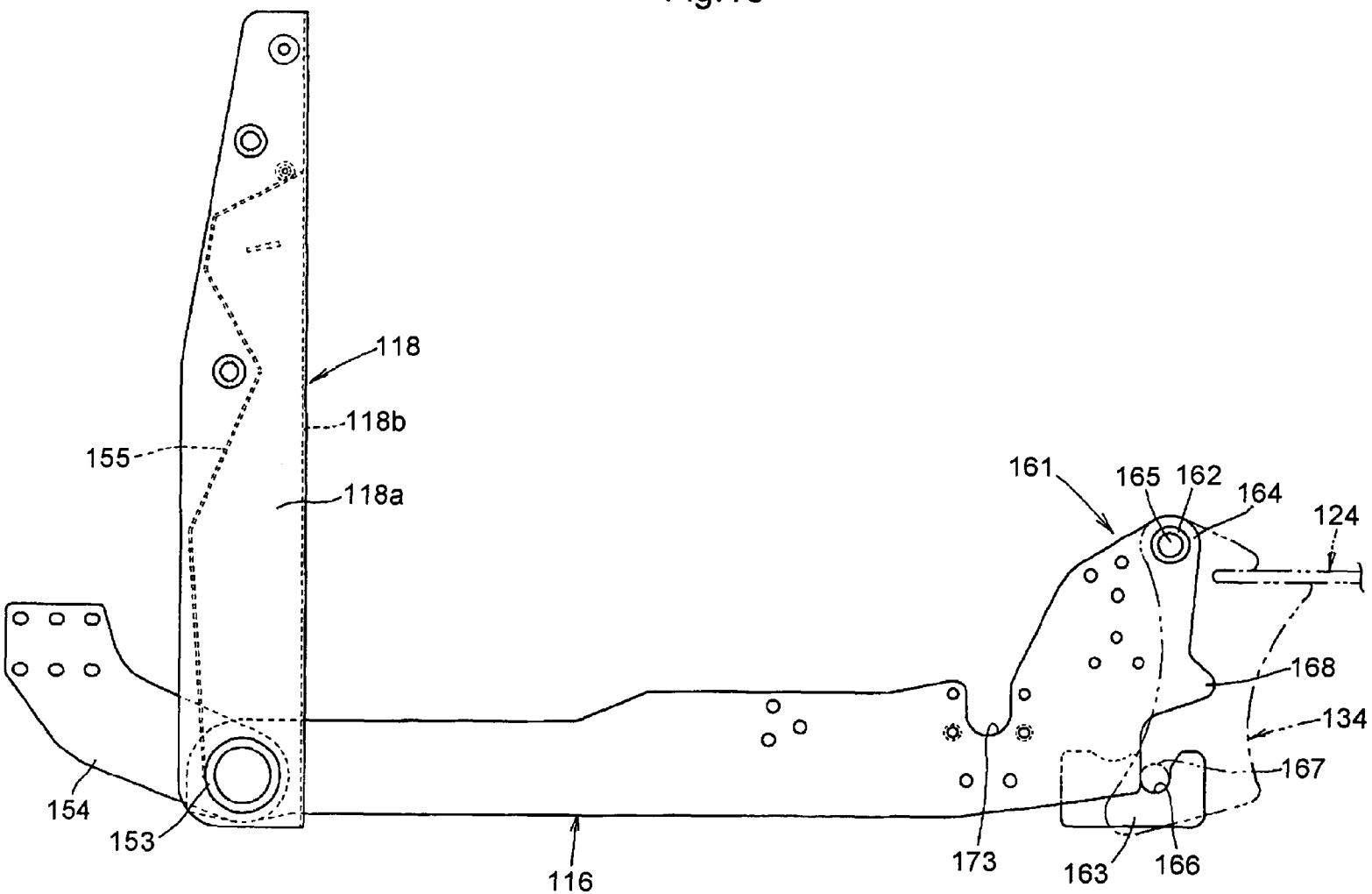
FIG. 16 is a side view of the implement mounting frame portion according to the further embodiment.

To the connecting portion 162, as shown in FIG. 16, there is connected a connected portion 164 provided at an upper portion of the attaching body 134 of the backhoe 104, via a connecting pin 165 extending through the connecting portion 162 and the connected portion 164 in the right/left direction.

The receiving member 163 is fixed to the inner face of the implement mounting frame 116 by e.g. welding and this receiving member 163 defines an upwardly open concave portion 166, in which there is fitted and engaged a connecting bar 167 provided at lower portion of the attaching body 134 of the backhoe 104 as illustrated in FIG. 16.

The connecting bar 167 extends in the right/left direction between and across the right and left attaching bodies 134 of the backhoe 104 and right and left opposed ends of this connecting bar 167 project outward in the right/left direction from the attaching bodies 134. And, the portions of this connecting bar 167 projecting outward in the right/left direction from the attaching bodies 134 are engaged in the concave portions 166 of the receiving members 163.

In the above-described attaching construction of the backhoe 104, if the backhoe 4 is to be detached from the implement mounting frames 116, the leg portions of the outriggers and the bucket 128 will be placed on the ground surface and under this condition, the connecting pin 65 will be withdrawn from the connecting portion 162 and the connected portion 164. Then, under this condition, the arm 27, the bucket 128 or the boom 126 will be operated to pivot the attaching bodies 134 to the rear side about the axis of the connecting bar 167. Then, e.g. the outriggers will be operated to lift up the attaching bodies 134 to detach the connecting bar 167 from the concave portion 166 upwardly. Then, under this condition, the tractor 102 will be moved forwardly to complete the detachment.

Further, at a vertically intermediate portion of the implement mounting frame 116, there is formed a regulating portion 168. This regulating portion 168 projects rearward to be located on the upper side of the concave portion 166 in the side view and regulates an upward movement of the connecting bar 167 of the backhoe 104 side to engage the concave portion 166.

Downwardly of the transmission case 110, there is disposed a connecting member 171 along the right/left direction, and this connecting member 171 interconnects rear ends of the pair of right and left implement mounting frames 116. At a rear portion of the implement mounting frame 116, there is provided a cutaway concave portion 173 which allows insertion therethrough of the projecting shaft portion 117*a* of the rear axle case 117. This cutaway concave portion 173 is open on its outer side, so that the projecting shaft portion 117*a* of the rear axle case 117 engages from the lower side thereof and the peripheral edge of the cutaway portion 173 is fixed to the rear axle case 117 by means of a fastener 174 such as a bolt. With this, the rear portions of the pair of right and left implement mounting frames 116 are directly affixed to the rear axle cases 117 with the fasteners 174 such as bolts. Incidentally, the cutaway concave portion 173 may be formed as a cutaway portion open on its lower side, so as to engage the projecting shaft portion 117*a* of the rear axle case 117 from the upper side.

Figure 13:
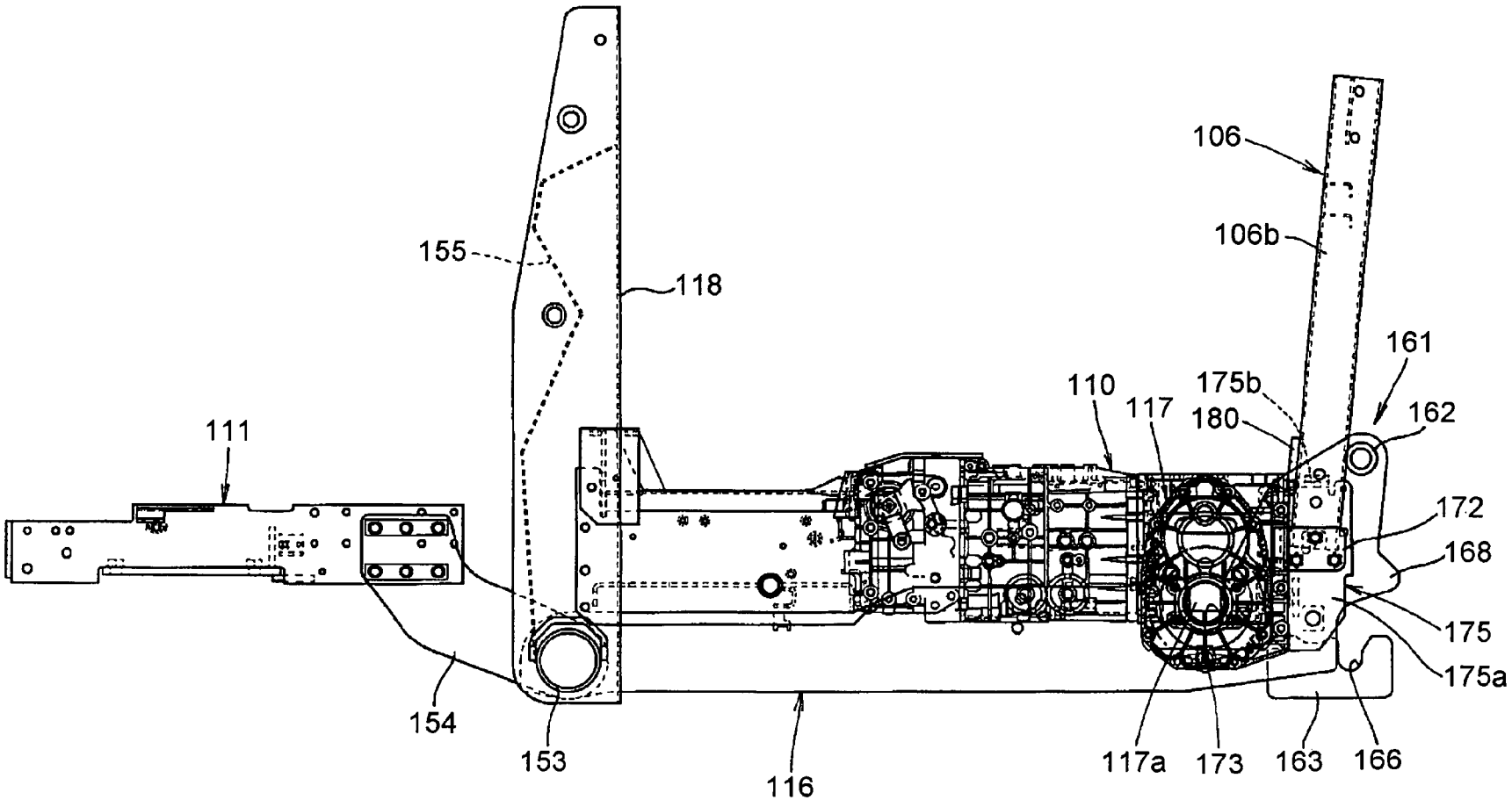
FIG. 13 is a side of the tractor vehicle body and the implement mounting frame portion relating to the further embodiment.
Figure 14:
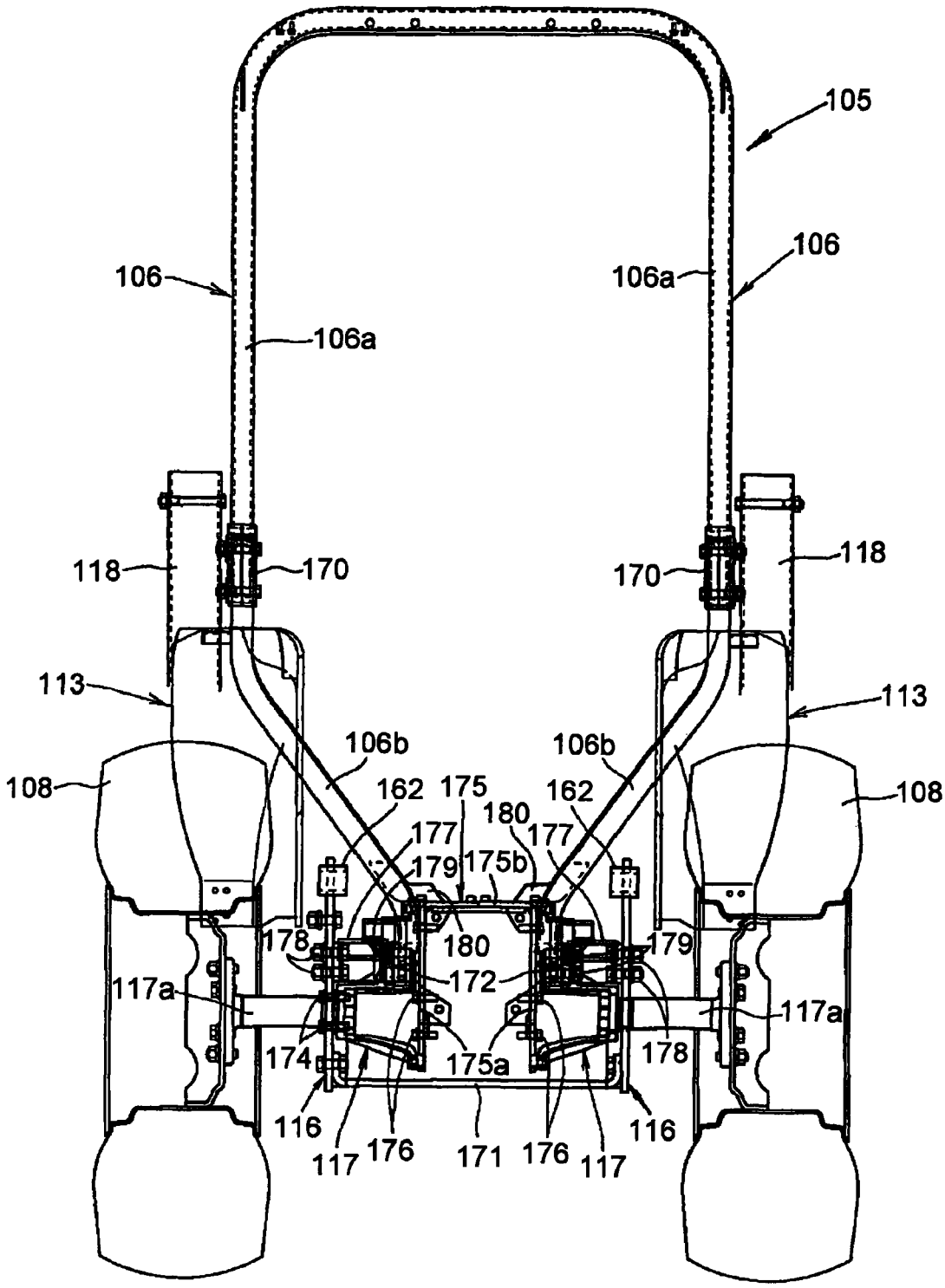
FIG. 14 is a rear view of the tractor vehicle body and the implement mounting frame portion relating to the further embodiment.
Figure 15:
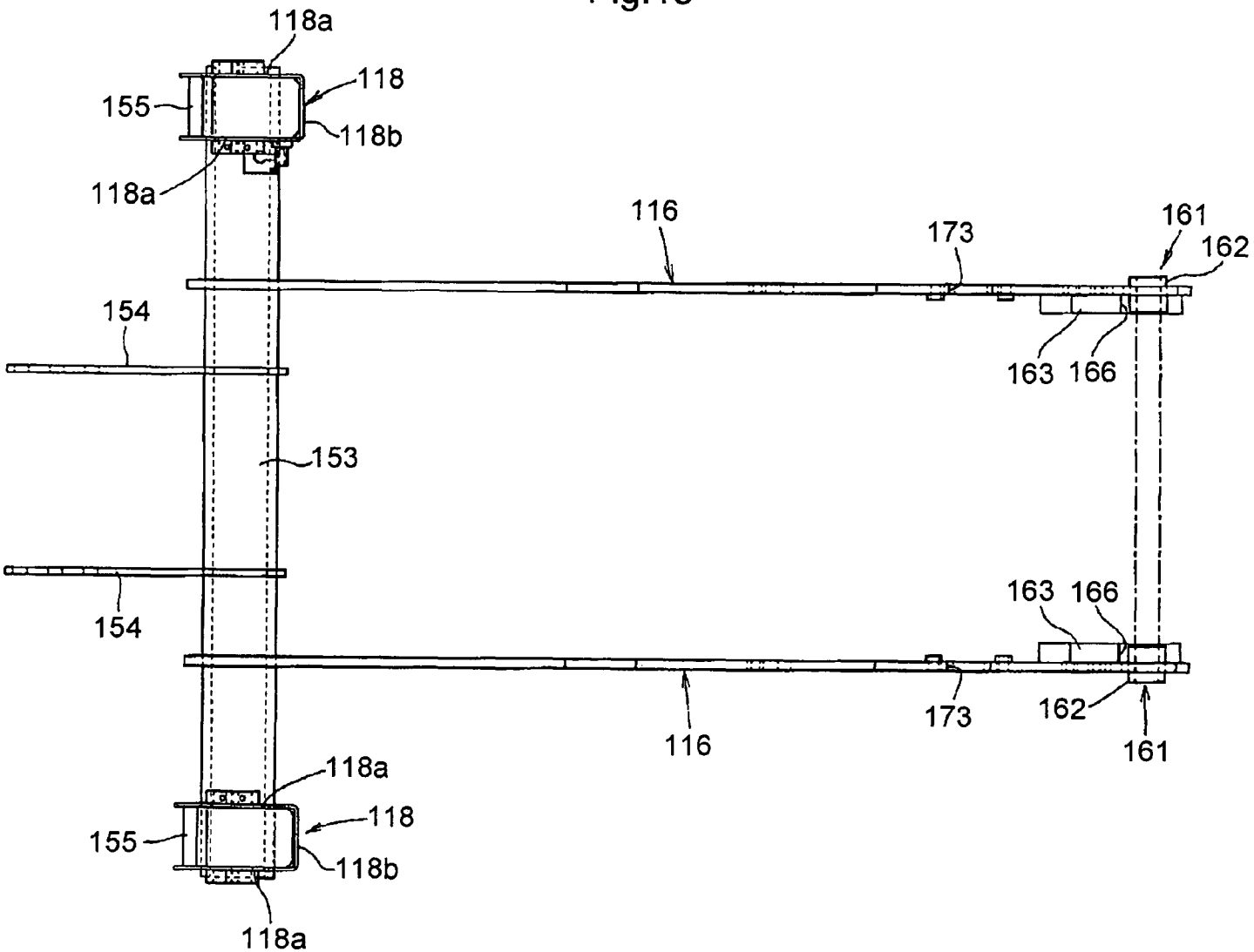
FIG. 15 is a plan view of an implement mounting frame portion according to a further embodiment.

In FIG. 13 and FIG. 14, the pair of right and left rear struts 106 of the ROPS 105 each includes an upper strut portion 106*a* and a lower strut portion 106*b* provided separately from each other. And, the upper strut portion 106*a* and the lower strut portion 106*b* are connected via a connecting cylindrical member 170, and the lower portions of the pair of rear struts 106, that is, the lower strut portions 106*b*, extend vertically through the rear ends of the rear wheel fenders 113 and then are bent to the right/left inner sides to be disposed rearwardly of the rear axles cases 117 and on the right/left inner sides than the rear portions of the pair of right and left implement mounting frames 116. As shown also in FIG. 18, to the lower end outer side of the lower strut portion 116*b*, an attaching plate 172 is attached by welding in the form of a downward projection therefrom.

An attaching frame 175 is provided so as to surround the upper face and the opposed outer faces of the transmission case 110. And, this attaching frame 175 is affixed to the transmission case 110 by means of a fastener 176 such as a bolt. The lower portion (lower strut portion 106*b*) of the rear strut 106 is affixed by welding via a connecting plate 180 to an upper frame portion 175*b* of the attaching frame 175. With this, the lower portions (lower strut portions 106*b*) of the rear struts 106 are affixed via the attaching frame 175 to the transmission case 110. 177*b*

Figure 18:
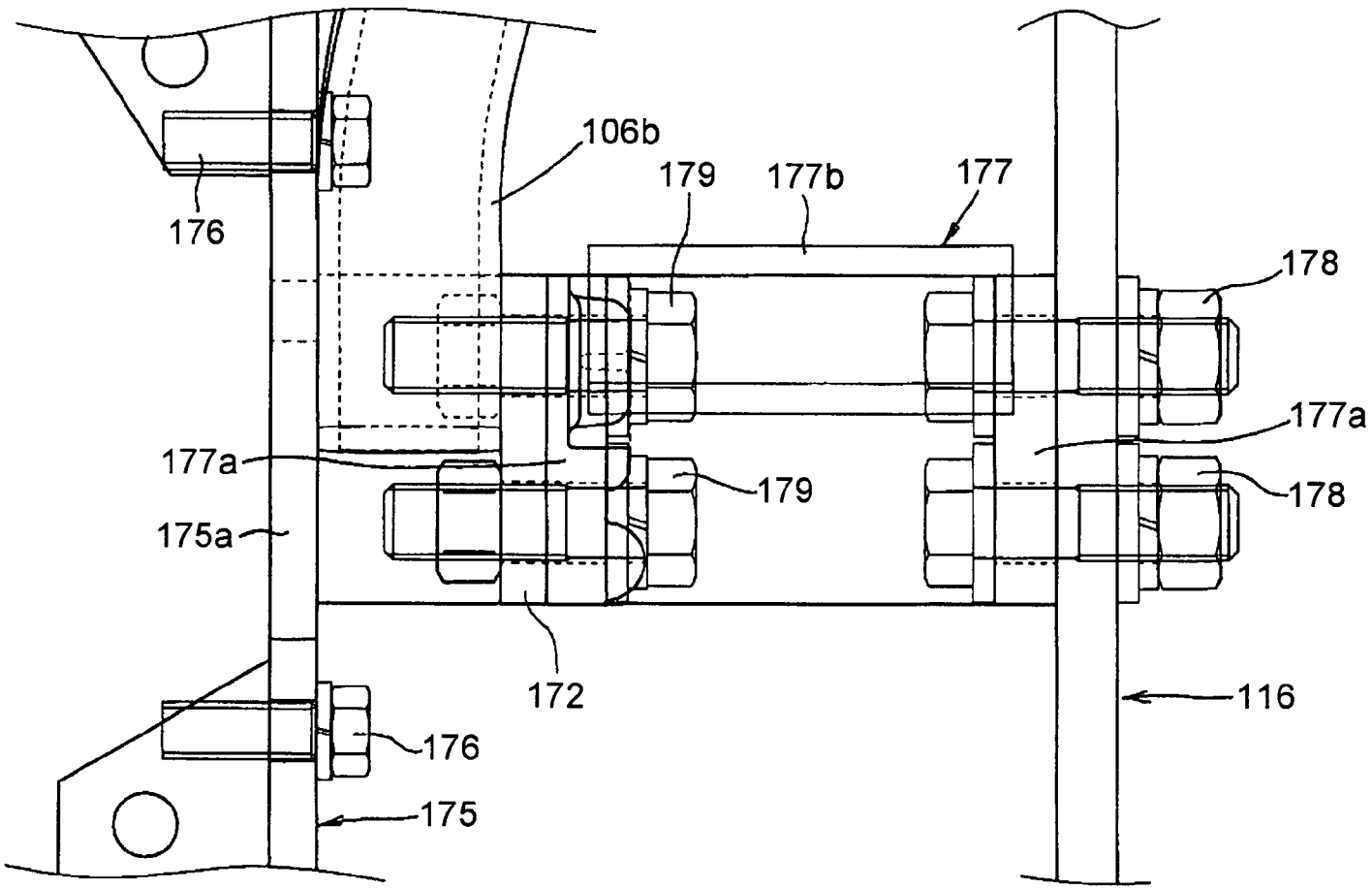
FIG. 18 is a rear view showing lower portions of rear struts, implement mounting frame and connecting member according to a further embodiment.

As shown also in FIG. 18, between the rear ends of the pair of right and left implement mounting frames 116 and the lower portions (lower strut portions 106*b*) of the rear struts 106 of the ROPS 105, there are interposed a pair of right and left connecting members 177, each connecting member 177 including a pair of right and left side plates 177*a* and a plurality of connecting plates 177*b* interconnecting the pair of side plates 177*a*. The outer side portions of the connecting members 177 are fixed to the rear ends of the implement mounting frames 116 by fasteners 178 such as bolts, whereas the inner side portions of the connecting members 177 are fixed to the lower portions of the rear struts 106 of the ROPS 105 by fasteners 179 such as bolts, whereby the portions of the pair of implement mounting frames 116 rearwardly of the portions thereof fixed to the rear axle cases 117 are connected via the respective connecting members 177 to the lower portions of the pair of rear struts 106*a*.

According to the above-described embodiment, the rear portions of the pair of right and left implement mounting frames 116 are directly fixed to the rear axle cases 177 by the fasteners 174 such as bolts. Hence, there is no need for brackets adapted for clamping the rear axle cases as provided in the conventional construction. As a result, the fixing construction for fixing the rear portions of the implement mounting frames 116 to the tractor vehicle body 102A is simplified, so that the attaching operation of the implement mounting frames 116 to the tractor vehicle body 102A is facilitated and the work vehicle 102A can be manufactured inexpensively.

Further, at the rear portions of the implement mounting frames 116, there are provided the cutaway concave portions 173 for allowing insertion of the projecting shaft portions 117*a* of the rear axle cases 17 and the peripheral edges of the cutaway concave portions 173 are affixed to the rear axle cases 177 by the fasteners 173 such as bolts. Accordingly, there occurs no obstruction by the projecting shaft portions 117*a*. And, it is possible to place the rear portions of the implement mounting frames 116 as close as possible to the outer end faces of the rear axle cases 117, so that the rear portions of the implement mounting frames 116 can be fixedly firmly and reliably by the fasteners 174.

Moreover, as the lower portions of the pair of right and left rear struts 6 of the ROPS 105 are disposed rearwardly of the respective rear axle cases 117 and on the right/left inner sides of the rear portions of the pair of right and left implement mounting frames 116 and fixed to the transmission case 110 and the portions of the pair of implement mounting frames 116 rearwardly of the portions thereof fixed to the rear axle cases 117 are connected via the respective connecting members 177 to the lower portions of the pair of rear struts 106*a*. Accordingly, the pair of right and left implement mounting frames 116 and the ROPS 105 can be formed integral with each other, thus allowing the ROPS 105 to reinforce the pair of right and left implement mounting frames 116 effectively. At the same time, the ROPS 105 can also be effectively reinforced by the pair of right and left implement mounting frames 116.

Also, to front portions of each right/left implement mounting frame 116, the support deck 153 extends therethrough in the right/left direction and is fixed thereto by welding. Via the support decks 153, front portions of the right and left implement mounting frames 116 are connected to each other. And, there are provided the pair of right and left loader attaching members 118 for detachably attaching the front loader 103, each loader attaching member 118 being attached to the right and left opposed ends of the support deck 153 by welding in the form of an upward projection therefrom. As a result, the pair of right and left implement mounting frames 116, the support decks 153 and the right and left loader attaching members 118 are integrated together by means of welding, thus rendering the front portions (loader attaching portions) of the pair of right and left implement mounting frames 116 strong. Moreover, in the case of the conventional construction in which the loader attaching members are bolt-fixed to the pair of right and left implement mounting frames, the construction is complicated and the number of elements thereof is large, so that the assembly operation of the loader attaching members to the implement mounting frames is troublesome and also there occurs such problem as development of looseness in the loader attaching members due to loosening of the bolts. Whereas, in the case of the above embodiment, no such problem occurs. And, the front portions (loader attaching portions) of the pair of right and left implement mounting frames 116 can be formed strong. At the same time, the assembly operation of the loader attaching member to the implement mounting frame 116 can be easily effected and the manufacturing costs of the work vehicle can be reduced also.

As described above, with the loader work apparatus of the present invention, it is possible to dispose a hydraulic hose without this hose extending on the inner or outer side of the mast, the hydraulic hose constituting a piping system extending from a control valve mounted on the vehicle body to a hydraulic actuator for an attachment to be mounted to the boom.

And, it is also possible to dispose a hydraulic hose constituting a piping system extending to a hydraulic actuator for an attachment, without causing the hose to extend on the inner or outer side of the mast.

DESCRIPTION OF REFERENCE NUMERALS AND MARKS

1 work vehicle
2 tractor
2*a* vehicle body

3 loader
4 loader work apparatus
15 driver's seat
20 control valve
20*a* main control valve
20*b* sub control valve
31 implement mounting frame
32 pressure oil communicating channel
33 support deck
34 attaching bracket
35L left mast
35R right mast
36 connecting frame
55L left mast
55R right mast
56 bucket
57 boom pivot portion
59 cylinder pivot portion
60L left boom cylinder
60R right boom cylinder
64 grapple
67 fork cylinder
73 right boom piping system
74 bucket piping system
76 hydraulic hose
78 hydraulic hose
82 left boom piping system
84 hydraulic hose
91 attaching piping system
93 hydraulic hose

The invention claimed is:

1. A work vehicle, comprising:

a vehicle body;

a loader work apparatus attached to the vehicle body;

a control valve for providing hydraulic fluid to the loader work apparatus; and the loader work apparatus comprising:

a mounting frame comprising a pair of laterally extending support decks;

right and left masts upstanding from the support decks, respectively;

right and left booms pivotally supported to the right and left masts;

an implement pivotally supported to the right and left booms;

right and left boom cylinders for pivoting the respective right and left booms relative to the right and left masts, each of the boom cylinders comprising a boom cylinder tube pivotally supported to its associated mast and a boom piston rod pivotally supported to its associated boom and projectable and retractable relative to the boom cylinder tube;

right and left implement cylinders for operating the implement; and a hydraulic fluid piping system extending from the control valve for providing hydraulic fluid at least to the right and left boom cylinders and the right and left implement cylinders, comprising:

a right boom piping system extending upward within the right mast and extending to the outside of the right mast between the pivotal connection of the right boom cylinder tube to the right mast and the pivotal connection of the right boom to the right mast for supplying hydraulic fluid to the right boom cylinder;

a left boom piping system extending upward within the left mast and extending to the outside of the left mast between the pivotal connection of the left boom cylinder tube to the left mast and the pivotal connection of the left boom to the left mast for supplying hydraulic fluid to the left boom cylinder;

an implement piping system extending upward through one of the right mast and the left mast for supplying hydraulic fluid to the right and left implement cylinders to operate the implement, the implement piping system extending to the outside of the mast between the pivotal connection of the boom cylinder tube to the boom and the pivotal connection of the boom to the mast through which the implement piping system extends, and the implement piping system extending along the boom toward a leading end thereof to pass above the pivotal connection of the boom piston rod to the boom; and an attachment piping system extending upward through the other of the right mast and the left mast for supplying hydraulic fluid to an attachment cylinder to operate an attachment, the attachment piping system extending to the outside of the mast between the pivotal connection of the boom cylinder tube to the boom and the pivotal connection of the boom to the mast through which the attachment piping system extends, and the attachment piping system extending along the boom toward a leading end thereof to pass above the pivotal connection of the boom piston rod to the boom; and wherein the implement piping system and the attachment piping system each extend at least to a connecting member connecting the right and left booms and are each supported to the connecting member.

2. The work vehicle as claimed in claim 1, wherein the implement piping system extends upward through the right mast for supplying hydraulic fluid to the right and left implement cylinders for operating the implement.

3. The work vehicle as claimed in claim 2, wherein the implement piping system extends to the outside of the right mast between the pivotal connection of the right boom cylinder tube to the right boom and the pivotal connection of the right boom to the right mast.

4. The work vehicle as claimed in claim 3, wherein the implement piping system extends along the right boom toward the leading end of the right boom.

5. The work vehicle as claimed in claim 4, wherein the implement piping system passes above the pivotal connection of the right boom piston rod to the right boom.

6. The work vehicle as claimed in claim 1, wherein the attachment piping system extends upward through the left mast for supplying hydraulic fluid to the attachment cylinder used to operate the attachment.

7. The work vehicle as claimed in claim 6, wherein the attachment piping system extends to the outside of the left mast between the pivotal connection of the left boom cylinder tube to the left boom and the pivotal connection of the left boom to the left mast.

8. The work vehicle as claimed in claim 7, wherein the attachment piping system extends along the left boom toward the leading end of the left boom.

9. The work vehicle as claimed in claim 8, wherein the attachment piping system passes above the pivotal connection of the left boom piston rod to the left boom.

10. The work vehicle as claimed in claim 1, wherein the implement piping system extends upward through the right mast for supplying hydraulic fluid to the right and left implement cylinders for operating the implement, and wherein the attachment piping system extends upward through the left mast for supplying hydraulic fluid to the attachment cylinder used to operate the attachment.

11. The work vehicle as claimed in claim 10, wherein the implement piping system extends to the outside of the right mast between the pivotal connection of the right boom cylinder tube to the right boom and the pivotal connection of the right boom to the right mast, and wherein the attachment piping system extends to the outside of the left mast between the pivotal connection of the left boom cylinder tube to the left boom and the pivotal connection of the left boom to the left mast.

12. The work vehicle as claimed in claim 11, wherein the implement piping system extends along the right boom toward the leading end of the right boom so as to pass above the pivotal connection of the right boom piston rod to the right boom, and wherein the attachment piping system extends along the left boom toward the leading end of the left boom so as to pass above the pivotal connection of the left boom piston rod to the left boom.

13. The work vehicle as claimed in claim 1, wherein the connecting member connects the right and left booms at a position forward of the pivotal connection of the right boom piston rod to the right boom and the pivotal connection of the left boom piston rod to the left boom.

14. A work vehicle, comprising:

a vehicle body;

a loader work apparatus attached to the vehicle body;

a control valve for providing hydraulic fluid to the loader work apparatus; and the loader work apparatus comprising:

a mounting frame comprising a pair of laterally extending support decks;

right and left masts upstanding from the support decks, respectively;

right and left booms pivotally supported to the right and left masts;

an implement pivotally supported to the right and left booms;

right and left boom cylinders for pivoting the respective right and left booms relative to the right and left masts, each of the boom cylinders comprising a boom cylinder tube pivotally supported to its associated mast and a boom piston rod pivotally supported to its associated boom and projectable and retractable relative to the boom cylinder tube;

right and left implement cylinders for operating the implement; and a hydraulic fluid piping system extending from the control valve for providing hydraulic fluid at least to the right and left boom cylinders and the right and left implement cylinders, comprising:

a right boom piping system extending upward within the right mast and extending to the outside of the right mast between the pivotal connection of the right boom cylinder tube to the right mast and the pivotal connection of the right boom to the right mast for supplying hydraulic fluid to the right boom cylinder;

a left boom piping system extending upward within the left mast and extending to the outside of the left mast between the pivotal connection of the left boom cylinder tube to the left mast and the pivotal connection of the left boom to the left mast for supplying hydraulic fluid to the left boom cylinder;

an implement piping system extending upward through one of the right mast and the left mast for supplying hydraulic fluid to the right and left implement cylinders to operate the implement, the implement piping system extending to the outside of the mast between the pivotal connection of the boom cylinder tube to the boom and the pivotal connection of the boom to the mast through which the implement piping system extends, and the implement piping system extending along the boom toward a leading end thereof to pass above the pivotal connection of the boom piston rod to the boom; and an attachment piping system extending upward through the other of the right mast and the left mast for supplying hydraulic fluid to an attachment cylinder to operate an attachment, the attachment piping system extending to the outside of the mast between the pivotal connection of the boom cylinder tube to the boom and the pivotal connection of the boom to the mast through which the attachment piping system extends, and the attachment piping system extending along the boom toward a leading end thereof to pass above the pivotal connection of the boom piston rod to the boom;

wherein the implement piping system extends upward through one of the right and left masts for supplying hydraulic fluid to the right and left implement cylinders for operating the implement, and wherein the attachment piping system extends upward through the other of the right and left masts for supplying hydraulic fluid to the attachment cylinder used to operate the attachment; and wherein the implement piping system and the attachment piping system each extend at least to a connecting member connecting the right and left booms and are each supported to the connecting member.

15. The work vehicle as claimed in claim 14, wherein the implement piping system extends to the outside of the mast between the pivotal connection of the boom cylinder tube to the boom and the pivotal connection of the boom to the mast through which the implement piping system extends, and wherein the attachment piping system extending to the outside of the mast between the pivotal connection of the boom cylinder tube to the boom and the pivotal connection of the boom to the mast through which the attachment piping system extends.

16. The work vehicle as claimed in claim 15, wherein the implement piping system extends along the boom toward a leading end of the boom so as to pass above the pivotal connection of the boom piston rod to the boom through which the implement piping system extends, and wherein the attachment piping system extends along the boom toward a leading end of the boom so as to pass above the pivotal connection of the boom piston rod to the boom through which the attachment piping system extends.

17. The work vehicle as claimed in claim 14, wherein the connecting member connects the right and left booms at a position forward of the pivotal connection of the right boom piston rod to the right boom and the pivotal connection of the left boom piston rod to the left boom.

* * * * *